US009964873B2

(12) United States Patent
Yamashita et al.

(10) Patent No.: US 9,964,873 B2
(45) Date of Patent: May 8, 2018

(54) TONER, DEVELOPER, IMAGE FORMING APPARATUS AND TONER HOUSING UNIT

(71) Applicants: Hiroshi Yamashita, Shizuoka (JP); Minoru Masuda, Shizuoka (JP); Hiroshi Yamada, Shizuoka (JP); Shizuka Hashida, Shizuoka (JP); Masanori Rimoto, Shizuoka (JP)

(72) Inventors: Hiroshi Yamashita, Shizuoka (JP); Minoru Masuda, Shizuoka (JP); Hiroshi Yamada, Shizuoka (JP); Shizuka Hashida, Shizuoka (JP); Masanori Rimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/167,182

(22) Filed: May 27, 2016

(65) Prior Publication Data

US 2016/0370720 A1 Dec. 22, 2016

(30) Foreign Application Priority Data

Jun. 22, 2015 (JP) ..... 2015-124594
Nov. 11, 2015 (JP) ..... 2015-221428

(51) Int. Cl.
*G03G 9/08* (2006.01)
*G03G 9/087* (2006.01)
*G03G 15/08* (2006.01)

(52) U.S. Cl.
CPC ..... *G03G 9/0821* (2013.01); *G03G 9/08755* (2013.01); *G03G 15/08* (2013.01)

(58) Field of Classification Search
CPC ..... G03G 9/0821; G03G 9/08755
USPC ..... 430/109.4, 111.4
See application file for complete search history.

(56) References Cited

U.S. PATENT DOCUMENTS

| | | | | |
|---|---|---|---|---|
| 6,055,390 | A | 4/2000 | Kurotaka et al. | |
| 7,262,262 | B2 * | 8/2007 | Matsumura | C08L 67/02 430/108.1 |
| 2006/0177756 | A1 | 8/2006 | Sugimoto et al. | |
| 2007/0292175 | A1 | 12/2007 | Shinshi | |
| 2008/0175633 | A1 | 7/2008 | Shinshi | |
| 2008/0219730 | A1 | 9/2008 | Shinshi | |
| 2008/0261131 | A1 * | 10/2008 | Nakayama | G03G 9/0823 430/48 |
| 2013/0196260 | A1 | 8/2013 | Yoshida et al. | |

(Continued)

FOREIGN PATENT DOCUMENTS

| | | |
|---|---|---|
| JP | 4-044075 | 2/1992 |
| JP | 8-262903 | 10/1996 |
| JP | 10-213984 | 8/1998 |

(Continued)

*Primary Examiner* — Mark A Chapman
(74) *Attorney, Agent, or Firm* — Oblon, McClelland, Maier & Neustadt, L.L.P.

(57) ABSTRACT

A toner fixable on an image bearer with heat. The toner has a first storage modulus of from $1\times10^3$ to $1\times10^6$ Pa, measured at 100° C. when being heated, and a second storage modulus of from $1\times10^3$ to $1\times10^6$ Pa, measured at 100° C. when being cooled, the first storage modulus and second storage modulus being measured by a rheometer, and the second storage modulus at 100° C. when being cooled is higher than the first storage modulus at 100° C. when being heated.

12 Claims, 2 Drawing Sheets

(56) References Cited

U.S. PATENT DOCUMENTS

2015/0024312 A1 1/2015 Shiba et al.

FOREIGN PATENT DOCUMENTS

| | | |
|---|---|---|
| JP | 11-002982 | 1/1999 |
| JP | 2006-208609 | 8/2006 |
| JP | 2007-334205 | 12/2007 |
| JP | 2008-158482 | 7/2008 |
| JP | 2008-216928 | 9/2008 |
| JP | 2010-077419 | 4/2010 |
| JP | 2010-151996 | 7/2010 |
| JP | 2013-156522 | 8/2013 |

* cited by examiner

TONER, DEVELOPER, IMAGE FORMING APPARATUS AND TONER HOUSING UNIT

TECHNICAL FIELD

The present invention relates to a toner, a developer, an image forming apparatus and a toner housing unit.

DESCRIPTION OF THE RELATED ART

Various electrophotographic image forming apparatuses have been developed as image forming apparatuses such as copiers and printers.

The image forming process includes a process of forming an electrostatic latent image on the surface of a photoconductor drum as an image bearer, a process of developing the electrostatic latent image with a developer such as a toner to form a visible image, a process of transferring the developed image onto recording paper with a transferer, and a process of fixing the toner image on the recording paper with a fixer using a pressure and a heat.

In the fixer, a fixing member and a pressure member formed of facing rollers, belts or their combinations contact each other to form a nip. Recording paper is inserted into the nip and heat and pressure are applied to the recording paper to fix the toner image on the recording paper.

These fixing devices are studied regarding significant improvement on heat conductivity efficiency, reduction of energy consumption, and downsizing. In addition, image forming apparatuses have been proposed which has advantages such as a short waiting time (quick-start) from power-on till ready to conduct image forming and significantly low energy consumption during standby (energy save) (Patent Publication Reference Nos. 1 to 7).

To save energy required by the fixing process, which needs much electricity to heat and melt the toner, low-temperature fixability of the toner has been one of important properties for the toner. To improve low temperature fixability of the toner, toner containing a crystalline resin as a binder resin has been used (for example, Patent Publication Reference Nos. 8 and 9),

SUMMARY OF THE INVENTION

Problems to be Solved

The low-temperature fixability of the toner is also desired to achieve downsizing, quick start, and power saving of the fixer. Therefore, toner softenable at low temperatures has been used.

When a large amount of duplex prints having large image areas stack in a paper ejection unit, a phenomenon so called ejected paper blocking phenomenon where the toner on a fixed image adheres to paper ejected thereon, so that output paper adheres to each other via the fixed image tends to occur. This phenomenon occurs when an image part of output paper overlaps where the toner is melted and fixed but still soft because the toner is not fully cooled.

Since there is a trade-off relation between the low-temperature fixability of toner and prevention of the ejected paper blocking, a technique to strike a balance between both is not found. The present invention is to provide toner having an excellent low temperature fixability and free of a phenomenon (ejected paper blocking) in which output sheets are caused to adhere to each other via a fixed image in view of the issues involved with prior art.

As a result of an intensive investigation made by the present inventors, the issues described above can be solved by the toner described in the following (1).

(1) Toner fixable on an image bearer with heat, characterized in that the storage modulus of the toner measured by a rheometer satisfies the following conditions:

the storage modulus G' at 100° C. during temperature rising is from $1\times10^3$ to $1\times10^6$ Pa the storage modulus G' at 100° C. during temperature falling is from $1\times10^3$ to $1\times10^6$ Pa Also, the storage modulus at 100° C. during temperature falling is higher than that at 100° C. during temperature rising.

Effects of the Invention

According to the present invention, it is possible to provide toner having an excellent low temperature fixability and free of a phenomenon (ejected paper blocking) in which output sheets are caused to adhere to each other via a fixed image.

EMBODIMENT FOR CARRYING OUT THE INVENTION

Prior Art

Figure 1:
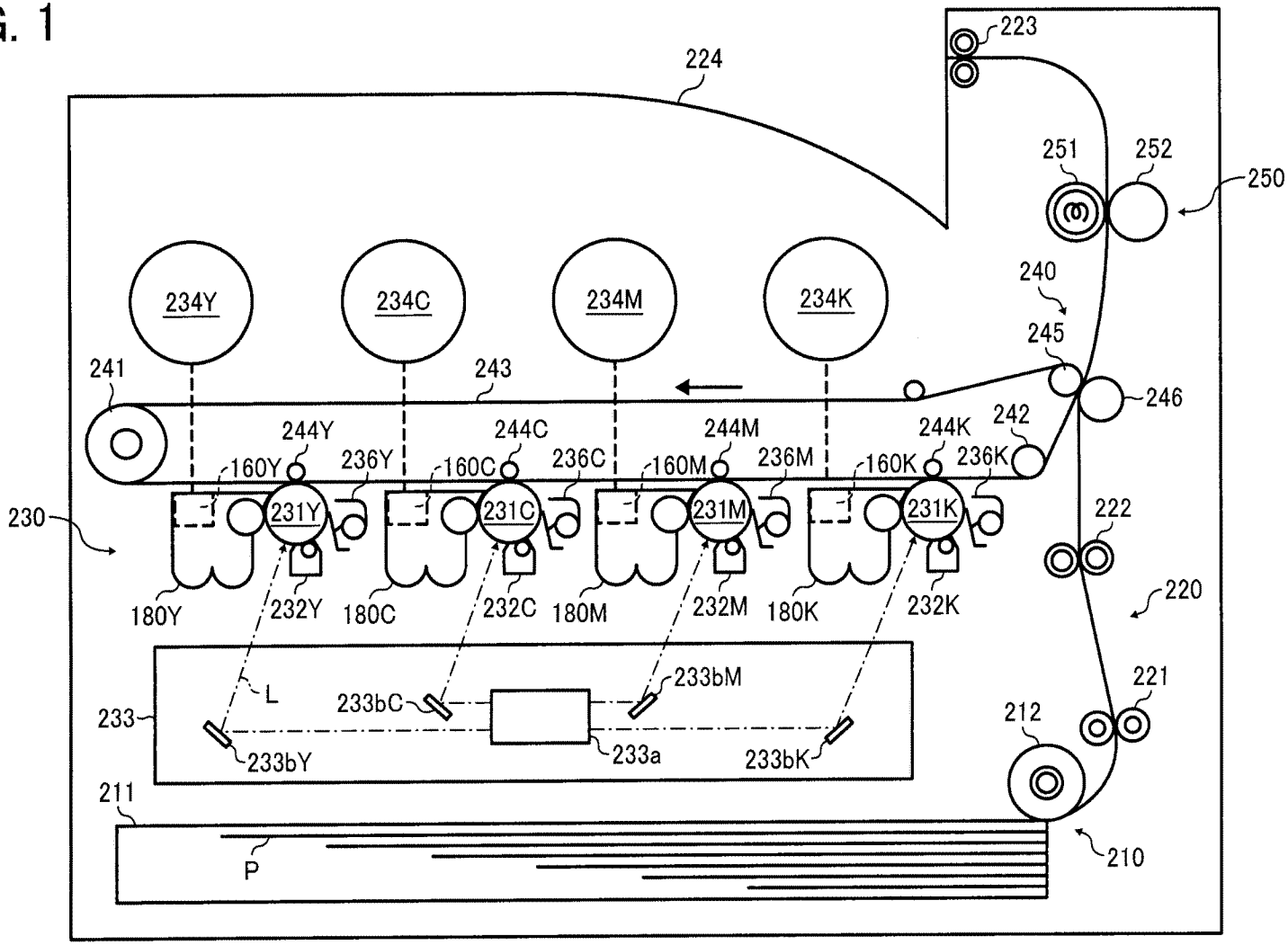
FIG. 1 A schematic diagram illustrating an embodiment of an image forming apparatus.

To prevent the ejected paper blocking, there is a method of blowing cooling air to the stacking ejected paper to cool them to prevent adherence of images with image substrates, paper, and images. However, this method needs an additional special device which is not mountable on low-cost machines. Even when toner has low-temperature fixability to reduce power consumption, the temperature of the stacking ejected paper does not lower unlike the fixing temperature and fixing energy, resulting in inability of preventing blocking.

Improvement of Resin

There is a method of making thermal fusion property of toner not easily flowable to decrease adhesiveness of images on the ejected paper. Therefore, a molecular weight of a resin forming the toner is increased, the melting point or the glass transition temperature (Tg) of the resin is increased, and the resin is caused to have a crosslinked structure.

However, this method invites a rise of the fixing temperature and causes sacrifice of energy saving. Images having high gloss are difficult to produce, and are not suitable for high-definition or high color clearness image forming systems.

Imparting Releasability

There is a method of increasing releasability of the surface of an image as well to prevent the output images from adhering to each other.

This is to bleed a wax as a release agent much on the surface of an image. However, it is necessary to increase the amount of wax to bleed the wax more or arrange the wax to be on the surface of toner to easily separate the wax from the toner. This tends to degrade fluidity and chargeability of the toner. Also, it is necessary to select wax having a low melting point for the toner to have low-temperature fixability.

Characteristics of Present Invention

In the present invention (Just true translation. Matumoto's has no problem, it was found that if melted toner had a storage modulus of from $1\times10^3$ to $1\times10^6$ Pa at 100° C. during temperature rising and a storage modulus of from $1\times10^3$ to $1\times10^6$ Pa at 100° C. during temperature falling, and the storage modulus at 100° C. during temperature falling was greater than during temperature rising, ejected paper blocking was able to be prevented by using toner fixable at low temperatures. Thus, the present invention was made.

In order for toner to have a storage modulus at 100° C. during temperature rising in a desirable range, a resin having a low Tg is selected to control the molecular weight and the molecular weight distribution. At this point, a crystalline resin or a plasticizer can be mixed to further control the storage modulus at the time of melting.

In addition, in order for toner to have a storage modulus at 100° C. during temperature falling, the quantity, the particle diameter, the dispersion status, etc. of a metal salt of a salicylic acid derivative added to a resin mentioned later as an additive are controlled.

Elasticity of the toner of the present invention changes due to the heat energy during fixing.

For example, hydrogen bond, covalent bond, ionic bond, and coordinate bond can be utilized to evoke an interaction between polymers of the resin. More preferably, utilizing the ionic bond is effective because changes tend to occur at low temperatures.

As a result, a polymeric component is produced so that the molecular weight of toner after heated increases. To improve blocking property, the toner preferably has a rate of change of a weight-average molecular weight of from 10% to 140%. When 140% or less, fixability is improved so that the toner easily adheres to paper, etc. Preferably, the change of rate is from 30% to 80% to satisfy both of the fixability and blocking property.

Conventionally, there is a technology utilizing such a bond to increase elasticity of toner when heated at high temperatures to prevent hot offset. In the present invention, even when the toner is heated at a low temperature of 100° C., an interaction between polymers is generated to prevent blocking.

In embodiments of the present invention, the ionic bond or the coordinate bond produced by heating a metal salt of a salicylic acid derivative and a polar group of the resin are utilized.

A resin having a carboxyl group is preferable as the resin. Particularly, a polyester resin having a carboxyl group at its distal end is suitable. The polyester resin preferably has an acid value of from 10 to 50 mgKOH/g, and more preferably from 20 to 40 mgKOH/g.

When plural resins are used, a low-molecular-weight and low-Tg resin may be mixed as a component if the low-temperature fixability is emphasized. At this point, when the low-molecular-weight and low-Tg resin has a high acid value, a crosslinking reaction preferentially occurs therewith. This makes the blocking property of the resultant low-temperature fixable toner better.

It is important to have a hydroxyl group to enhance bonds between polymers. The hydroxyl value is preferably from 5 to 40 mgKOH/g, and more preferably from 10 to 30 mgKOH/g.

The metal salt of a salicylic acid derivative represented by the following formula (1) is preferable:

Formula 1

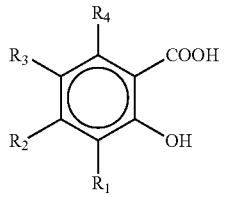

(1)

In the formula (1), $R_1$, $R_2$, $R_3$, and $R_4$ independently represent a member selected from the group consisting of hydrogen atoms, alkyl groups having 1 to 12 carbon atoms, alkenyl groups having 2 to 12 carbon atoms, —OH, —$NH_2$, —$NH(CH_3)$, —$N(CH_3)_2$, —$OCH_3$, —$O(C_2H_5)$, —COOH, and —$CONH_2$.

A metal forming the metal salt is $Zn^{2+}$, $Al^{3+}$, $Cr^{3+}$, $Fe^{3+}$, or $Zr^{4+}$.

Among the metal salts of a salicylic acid derivative having the formula (1), a tri- or more valent metals efficiently performing interactions are preferably used.

Particularly, a zirconium compound having the following formula (2) is preferable:

Formula (2)

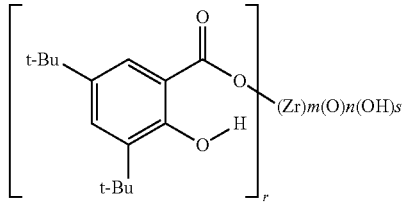

(2)

In the formula (2), m represents an integer of from 1 to 20, n represents 0 or an integer of from 1 to 20, s represents 0 or an integer of from 1 to 20, r represents an integer of from 1 to 20; and t-Bu represents a tertiary butyl group.

Change of Molecular Weight

The molecular weight of the toner of the present invention increases when heated. Polymeric components therein increase when heated at 100° C. and the weight-average molecular weight increases. However, the maximum molecular weight does not vary much. Therefore, cross-linking reaction is thought to occur to a part of the polymeric components.

A rate of change $R_M$ (%) calculated from the following relation (1) is preferably from 10% to 140% and more preferably from 30% to 80%. In the relation (1), Mw1 represents a weight-average molecular weight of the toner before temperature rising and Mw2 represents a weight-average molecular weight thereof after temperature falling.

$$R_M = \frac{Mw2 - Mw1}{Mw1} \times 100 \quad (1)$$

Decrease of Acid Value

As the reaction proceeds, the acid value of toner decreases. The rate of the decrease is thought to depend on the acid value of toner before heated and the existence state of the metal salt of a salicylic acid derivative. The rate of change $R_{AV}$ (%) calculated from the following relation (2) is preferably from 20% to 80%. In the relation (2), Av1 represents the acid value of the toner before temperature rising and Av2 represents an acid value thereof after temperature falling.

$$R_{AV} = \frac{Av2 - Av1}{Av1} \times 100 \quad (2)$$

The acidic group preferably has a larger rate of change of the acid value in terms of preventing blocking because the acid group reacts with the metal salt of salicylic acid, which increases the storage modulus of a resin.

Meanwhile, the rate of change of the acid value may not be too large in terms of fixability (adhesiveness to paper) because the existence of the acidic group improves fixability.

Therefore, the rate of change of the acid value is preferably from 20% to 80% to improve fixability and blocking property.

Conventionally, metal salts of salicylic acid derivatives are added to a resin as a charge controlling agent. For example, the metal salt of a salicylic acid derivative is added to a resin and melt-kneaded and pulverized to prepare a pulverization toner. However, since the toner is heated in the step of obtaining the toner if such processes of melt-kneading and pulverizing, elasticity of the toner after temperature rising is not larger than that thereof before temperature rising.

The conventional metal salt of a salicylic acid derivative added to a resin as a charge controlling agent may be present at the surface of toner and need not be uniformly dispersed therein.

In the present invention, the metal salt of a salicylic acid derivative may not react in toner before temperature rising but needs to react with a resin during temperature rising.

Therefore, it is important not to provide a heating process at high temperatures to avoid reaction during the processes of producing toner. It is preferable to select a process of producing toner without a heating process at temperatures not lower than Tg+20° C. of the toner. When the processes of producing a toner includes a heating process at temperatures not lower than the Tg+20° C., cross-linking of a resin in the toner is promoted so that elasticity of the toner increases, thereby degrading the low-temperature fixability.

It is important that the metal salt of a salicylic acid derivative is molecularly dissolved or dispersed in the shape of a fine particle or a crystal in toner to effectively conduct reaction between the metal salt of a salicylic acid derivative and a resin by heating at low temperatures. Therefore, a salt needs to be formed in toner in the process of producing the toner or a fine dispersion process needs to be provided.

The toner preferably has a storage modulus G' of from $1\times10^3$ to $1\times10^6$ Pa at 100° C. during temperature rising and more preferably from $1\times10^4$ to $3\times10^5$ Pa at 100° C. during temperature rising to achieve low-temperature fixing. When the storage modulus G' at 100° C. during temperature rising is not greater than $1\times10^6$ Pa, it means that the toner has good thermoplasticizability and is fixed at low temperature. When the storage modulus during temperature rising is less than $1\times10^3$ Pa, the toner is difficult to have storage property.

It is preferable that the storage modulus G' at 100° C. during temperature falling is from $1\times10^3$ to $1\times10^6$ Pa and the value at 100° C. during temperature falling is greater than the storage modulus at 100° C. during temperature rising. More preferably, the storage modulus G' at 100° C. during temperature falling is from $1\times10^4$ to $3\times10^5$ Pa and the value at 100° C. during temperature falling is greater than the storage modulus at 100° C. during temperature rising. Under these condition s, image (print) portions at ejection paper temperature are sufficiently hard and not fusion-bonded with each other so that ejected paper blocking can be prevented. When the storage modulus G' during temperature rising is greater than $1\times10^6$ Pa, the toner has high elasticity during fixing, resulting in insufficient gloss of images.

It is also found that when the elasticity during temperature rising and temperature falling is within the ranges specified above and the elasticity after temperature falling increases relative to the elasticity during temperature rising, output images have good storage property. That is, not only when paper is ejected, but also when images are stored at high temperature and high humidity, the image adheres to paper or the image i.e., a document offset phenomenon occurs. However, images after fixing is crosslinked so that strength increases. As a result, the image is not easily affected by heat and moisture.

A chemical toner production method is suitable to make a fine salicylic acid derivative compound present in toner. Specific examples thereof include the followings.

1) A process of finely dispersing the salicylic acid derivative compound mechanically in an oil phase is provided in suspension polymerization methods and dissolution suspension methods.

2) In the suspension polymerization methods and dissolution suspension methods, there is a method of synthesizing the salicylic acid derivative compound in an oil phase in-situ as a method of producing fine crystals and particles in an oil phase (a polymerizable monomer or a resin solvent solution). For example, an aqueous solution of 1,3-di-t-butyl salicylic acid and an aqueous solution of zirconium oxychloride are placed in an oil phase to conduct reaction to produce a fine zirconium compound in toner materials. Water or a polar solvent such as alcohol and ether may be present in the oil phase to smoothly proceed the reaction.

3) A process of finely dispersing the salicylic acid derivative compound mechanically in an aqueous phase is provided in emulsion aggregation methods. Thereafter, the salicylic acid derivative compound is aggregated or particulated with other toner materials such as resin latex to form toner.

4) In the emulsion aggregation methods, there is a method of synthesizing the salicylic acid derivative compound in an aqueous phase as a method of producing fine crystals and particles in an aqueous phase. For example, an aqueous solution of 1,3-di-t-butyl salicylic acid and an aqueous solution of zirconium oxychloride are placed in an aqueous phase to conduct reaction therein to precipitate and produce a fine zirconium compound in the aqueous phase. Thereafter, the salicylic acid derivative compound is aggregated or particulated with other toner materials such as resin latex to form toner. The fine particles are preferably fusion-bonded at temperatures as low as possible to prevent crosslinking reaction in the toner. For example, a resin emulsion using an organic solvent is efficiently used as a binder resin material.

In the present invention, the salicylic acid derivative compound is thought to take a crosslinking structure with a polyester resin in toner when the temperature rises, thereby increasing storage modulus of the toner. To take in the zirconium compound illustrated above in toner, the heating temperature is preferably not higher than Tg+20° C. of the resin and more preferably not higher than Tg in the manufacturing process. When not lower than Tg+20° C., the salicylic acid derivative compound further crosslinks with the toner, which increases the storage modulus of toner during temperature rising so that low-temperature fixability may deteriorate.

The toner preferably includes the salicylic acid derivative compound in an amount of from 0.01% to 10% by mass and more preferably from 0.1% to 2% by mass. When the amount of the salicylic acid derivative compound is 0.01% by mass or greater, the storage modulus during temperature falling can be increased. When the amount of the salicylic acid derivative compound is 10% by mass or less, the salicylic acid derivative compound in the toner does not impair low-temperature fixability of the toner.

In the toner of the present invention, a crystalline polyester resin and a polyester resin (amorphous polyester resin) having a low glass transition temperature are effectively used to achieve low temperature fixing.

<Measurement of Storage Modulus G'>

The storage modulus (G' 100) at 100° C. during temperature rising and temperature falling in the present invention is measured by the following method. The measuring device used is a rotational plate rheometer "ARES" from TA Instruments Japan Inc.

A sample is formed into a pellet having a disk-like form with a diameter of 8.0±0.3 mm and a thickness of 1.0±0.3 mm at 25° C. using a pellet molder.

The pellet sample is fixed to a parallel plate having a diameter of 8.0 mm and stabilized at 40° C. Thereafter, the sample is heated to 120° C. at 2.0° C./min with a frequency of 10 Hz (6.28 rad/s) and a strain of 0.1% (in a strain control mode) and thereafter cooled down to 40° C. at 2.0° C./min.

It is important to set a sample such that the initial normal force is 0. As mentioned below, Auto Tension Adjustment is on for the measuring thereafter to cancel the influence of the normal force.

The apparatus is set as follows in detail when the storage modulus G' is measured.

(1) A parallel plate having a diameter of 8.0 mm is used.
(2) Frequency is 10 Hz (6.28 rad/s).
(3) Initial strain is 0.1%.
(4) Ramp Rate is 2.0° C./min from 40° C. to 200° C. The auto strain control mode is used for measuring in the setting of the following auto control mode.
(5) Max Applied Strain is 200%.
(6) Max Allowed Torque is 500 g·cm and Min Allowed Torque is 500 g·cm.
(7) Strain Adjustment is 15% of Current Strain. Auto Tension is used for the measuring.
(8) Auto Tension Direction is set to Compression.
(9) Initial Static Force is 10.0 g and Auto Tension Sensitivity is 300 g.
(10) Operation conditions of Auto Tension includes Sample Modulus not less than 10 (Pa).

The storage modulus G' at 100° C. during temperature rising is defined as G'↑100 when measuring the storage modulus G' from 40° C. to 120° C. by the method described above.

The storage modulus G' at 100° C. during temperature falling is defined as G'1100 when measuring the storage modulus G' from 120° C. to 40° C. by the method described above.

<Amorphous Polyester Resin>

Details of the constituents of an amorphous polyester resin are as follows.

———Diol———

Diols are not particularly limited if they include aliphatic diols having 3 to 10 carbon atoms in an amount not less than 50% by mol, and specific examples include aliphatic diols such as ethylene glycol, 1,2-propylene glycol, 1,3-propylene glycol, 1,4-butanediol, 3-methyl-1,5-pentanediol, and 1,6-hexanediol, 1,8-octanediol, 1,10-decanediol, and 1,12-dodecanediol; diols having an oxyalkylene group such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; adducts of alicyclic diols with an alkylene oxide such as ethylene oxide, propylene oxide, and butylene oxide; bisphenols such as bisphenol A, bisphenol F, and bisphenol S; and alkyleneoxide adducts of bisphenols with an alkylene oxide such as ethylene oxide, propylene oxide and butylene oxide. In particular, aliphatic diols having 4 to 12 carbon atoms are preferable. These diols can be used alone or in combination.

———Dicarboxylic Acid$_o$

Dicarboxylic acid is not particularly limited and can be suitably selected to suit to a particular application. Specific examples include aliphatic dicarboxylic acids and aromatic dicarboxylic acids. Their anhydrides, lower (having 1 to 3 carbon atoms) alkyl esterified compounds, and halogenated compounds may be used.

Specific examples of aliphatic dicarboxylic acid include succinic acid, adipic acid, sebacic acid, dodecanedioic acid, maleic acid, and fumaric acid.

Specific examples of aromatic dicarboxylic acid include phthalic acid, isophthalic acid, terephthalic acid, naphthalene dicarboxylic acid. Among these, aliphatic dicarboxylic acids having 4 to 12 carbon atoms are preferable.

These dicarboxylic acids may be used alone or in combination

———Tri- or Higher Valent Aliphatic Alcohol———

Tri- or higher valent aliphatic alcohol has no particular limit and can be suitably selected to suit to a particular application. Specific examples include glycerin, trimethylolethane, trimethylolpropane, pentaerythritol, sorbitol, and dipentaerythritol.

Among these, tri- to tetravalent aliphatic alcohols are preferable. These tri- or higher valent aliphatic alcohols can be used alone or in combination.

The acid value of amorphous polyester resin has no particular limit and can be suitably selected to suit to a particular application. Preferably, it is not less than 10 mg KOH/g and more preferably not less than 20 mg KOH/g to have desired low-temperature fixability in terms of affinity between paper and resins. Meanwhile, it is not greater than 50 mg KOH/g to improve hot offset resistance.

The hydroxyl value of the crystalline polyester resin has no particular limit and can be suitably selected to suit to a particular application. Preferably, it has a hydroxyl value of from 5 to 40 mg KOH/g and more preferably from 10 to 30 mg KOH/g to have desired low-temperature fixability and good blocking property.

In the present invention, the acid value of the binder resin component of the toner composition can be measured by the following method. The basic operation is according to JIS K-0070 format.

(1) 0.5 to 2.0 g of the toner is precisely weighed and the weight of the polymer composition is defined as W g.

(2) A sample is placed in a beaker (300 ml) and 150 ml of a mixture of toluene/ethanol (volume ratio 4/1) is added thereto to dissolve the sample.

(3) The solution is titrated with a potentiometric titrator using an ethanol solution 0.1 mol/l KOH.

(4) The amount of the KOH solution is S (ml) and at the same time, the amount of the KOH solution without the sample is measured as B (ml). The acid value is calculated from the following relation (C): In the relation (C), f represents a factor of KOH.

$$\text{Acid value (mgKOH/g)}=[(S-B)\times f\times 5.61]/W \qquad \text{Relation (C)}$$

A polyester resin including a urethane bond and a urea bond is used to control viscoelasticity of toner with hydrogen bond power.

——Polyester Resin Having Urethane Bond and Urea Bond——

The polyester resin including a urethane bond and a urea bond has no particular limit and can be suitably selected to suit to a particular application.

An example is a reaction product of a polyester resin having an active hydrogen group and a polyisocyanate.

———Polyisocyanate———

The polyisocyanate has no particular limit and can be suitably selected to suit to a particular application. Examples thereof are diisocyanate and tri- or higher valent isocyanate.

Specific examples of the diisocyanate include aliphatic diisocyanate, alicyclic diisocyanate, aromatic diisocyanate, aromatic aliphatic diisocyanate, isocyanurates, and block products thereof where the foregoing compounds are blocked with phenol derivatives, oximes, caprolactam, etc.

The aliphatic diisocyanate has non particular limit and can be suitably selected to suit to a particular application. Specific examples include tetramethylene diisocyanate, hexamethylene diisocyanate, 2, 6-diisocyanato methyl caproate, octamethylene diisocyanate, decamethine diisocyanate, dodecamethylene diisocyanate, tetra decamethylene diisocyanate, trimethyl hexane diisocyanate, and tetramethyl hexane diisocyanate.

The alicyclic diisocyanate has no particular limit and can be suitably selected to suit to a particular application. Specific examples include isophorone diisocyanate and cyclohexylmethane diisocyanate.

The aromatic diisocyanate has no particular limit and can be suitably selected to suit to a particular application. Specific examples include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether.

The aromatic aliphatic diisocyanate has no particular limit and can be suitably selected to suit to a particular application. Specific examples include α,α,α',α'-tetramethylxylylene diisocyanate.

The isocyanurate has no particular limit and can be suitably selected to suit to a particular application. Specific examples include tris(isocyanatoalkyl)isocyanurate and tris (isocyanatocycloalkyl)isocyanurate.

These polyisocyanates may be used alone or in combination and are preferably used as reactive precursors (prepolymer) reacting with a curing agent mentioned later.

—Curing Agent—

The curing agent is not particularly limited and can be suitably selected to suit to a particular application so long as it can react with prepolymers. For example, active hydrogen group-containing compounds are usable.

——Active Hydrogen Group-Containing Compound——

The active hydrogen group in the active hydrogen group-containing compound is not particularly limited and can be suitably selected to suit to a particular application. Examples are a hydroxyl group (e.g., an alcoholic hydroxyl group and a phenolic hydroxyl group), an amino group, a carboxyl group, and a mercapto group. These may be used alone or in combination.

The active hydrogen group-containing compound has no particular limit and can be suitably selected to suit to a particular application. Amines are preferable because it can form a urea bond.

The amines have no particular limit and can be suitably selected to suit to a particular application. Specific examples include diamine, tri- or higher valent amine, amino alcohol, amino mercaptan, amino acid, and compounds in which the amino groups of the foregoing compounds are blocked. These may be used alone or in combination Among them, diamine and a mixture of diamine and a small amount of tri- or higher valentamine are preferable.

The diamine has no particular limit and can be suitably selected to suit to a particular application. Specific examples include aromatic diamine, alicyclic diamine, and aliphatic diamine.

The aromatic diamine has no particular limit and can be suitably selected to suit to a particular application. Specific examples include phenylenediamine, diethyl toluene diamine, and 4,4'-diaminodiphenylmethane.

The alicyclic diamine includes 4,4'-diamino-3,3'-dimethyldicyclohexyl methane, diamino cyclohexane, and isophoronediamine.

The aliphatic diamine has no particular limit and can be suitably selected to suit to a particular application. Specific examples include ethylene diamine, tetramethylene diamine, and hexamethylenediamine.

The tri- or higher valentamine has no particular limit and can be suitably selected to suit to a particular application. Specific examples include diethylenetriamine and triethylene tetramine.

The amino alcohol has no particular limit and can be suitably selected to suit to a particular application. Specific examples include ethanol amine and hydroxyethyl aniline.

The amino mercaptan has no particular limit and can be suitably selected to suit to a particular application. Specific examples include aminoethyl mercaptan and aminopropyl mercaptan.

The amino acid has no particular limit and can be suitably selected to suit to a particular application Specific examples include amino propionic acid and amino caproic acid.

The compound where the amino group is blocked has no particular limit and can be suitably selected to suit to a particular application. Specific examples include a ketimine compound where the amino group is blocked with a ketone such as acetone, methyl ethyl ketone, and methyl isobutyl ketone and an oxazoline compound.

The molecular structure of the amorphous polyester resin can be measured by solution-state or solid-state NMR, X-ray diffraction, GC/MS, LC/MS, or IR spectroscopy. Simple methods for confirming the molecular structure include a method for detecting, as the polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

The content of the amorphous polyester resin used as the prepolymer mentioned above is not particularly limited and can be suitably selected to suit to a particular application Preferably, it is from 5 parts to 25 parts by mass and more preferably from 10 parts by mass to 20 parts by mass per 100 parts by mass of the toner. When less than 5 parts by mass, low-temperature fixability and hot offset resistance may deteriorate. When greater than 25 parts by mass, heat resistance storage property and the degree of gloss of images after fixing may deteriorate. When the content is within the more preferable range specified above, it is advantageous that all of low-temperature fixability, hot offset resistance, and heat resistance storage property is excellent.

<Crystalline Polyester Resin>

Having crystallinity, the crystalline polyester resin has heat meltability having a sharp drop of viscosity around a fixing starting temperature so that it may be used with the amorphous polyester resin.

When the crystalline polyester resin having such properties is used together with the amorphous polyester resin mentioned above, toner having both good heat resistance storage property and good low temperature fixability is obtained because heat resistance storage property is good just before the melt starting temperature due to its crystallinity but at the melt starting temperature, viscosity sharply drops due to melting of the crystalline polyester resin so that the crystalline polyester resin becomes compatible with the amorphous polyester resin and viscosity of both sharply drops, which promotes fixing. In addition, the result of the release width (difference between the fixable minimum temperature and the temperature at which hot offset occurs) is good.

The crystalline polyester resin is obtained by using polyols and polycarboxylic acids or derivatives thereof such as polycarboxylic acid anhydrides and polycarboxylic acid esters.

In the present invention, crystalline polyester resin means, as described above, articles obtained by using polyols and polycarboxylic acids or derivatives thereof such as polycarboxylic acid anhydrides and polycarboxylic acid esters. The crystal polyester resin does not include modified polyester resins such as the prepolymer mentioned above and resins obtained by crosslinking and/or elongating the prepolymer.

The crystalline polyester resin for use in the present invention preferably has a half-value width less than 1.0°/2θ in its X-ray diffraction and more preferably less than 0.6°/2θ. When less than 1.0°/2θ, the crystalline polyester resin has low crystallinity so that sharp meltability is inferior, resulting in insufficient low-temperature fixability.

The crystalline polyester resin preferably has a half-value width of the peak less than 1.0° in X-ray diffraction and more preferably less than 0.6° after dissolved and recrystallized in an organic solvent. When the half value width of the peak after dissolution and recrystallization of the crystalline polyester is (同上) less than 1.0°, the crystalline polyester resin present in toner has low crystallinity and is partially compatible with the amorphous polyester, resulting in deterioration of low-temperature fixability and heat resistance storage property. In addition, filming of the crystalline polyester resin tends to occur in an image developer, resulting in contamination thereof and deterioration of image quality.

(Measuring of Half Value Width of Peak by X Ray Diffraction)

X-ray diffraction measurement of the crystalline polyester can be conducted by a crystal analysis X-ray diffractometer (X'Pert Pro MRD from Philips N.V.). The measuring method is as follows. First, a target sample is ground in a mortar to prepare sample powder. The thus-obtained sample powder is uniformly applied to a sample holder. The sample holder is set in the diffractometer for measuring to obtain a diffraction spectrum.

The diffraction peaks obtained within a range of 20°<2θ<25° are defined as P1, P2 . . . in order of decreasing of the peak intensity.

Figure 3:
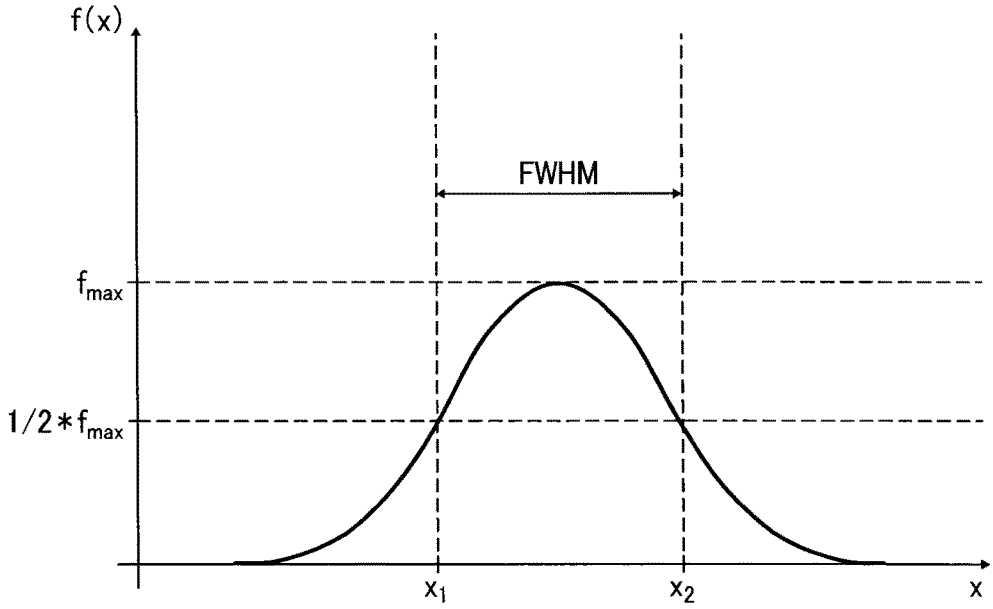
FIG. 3 A diagram illustrating a method of determining a peak half value width of crystalline polyester by X-ray diffraction measurement.

A peak half-value width (FWHM) is defined as the difference between the point x1 and the point x2, which are the half of the maximum peak intensity as illustrated in FIG. 3.

Measuring conditions of the X-ray diffraction are as follows.

Tension kV: 45 kV
Current: 40 A
MPSS
Upper
Gonio
Scanmode: continuous
Start angle: 3°
End angle: 35°
Angle Step: 0.02°
Lucident beam optics
Divergence slit: Div slit ½
Difflection beam optics
Anti scatter slit: As Fixed ½
Receiving slit: Prog rec slit (Method of Dissolving and Recrystallizing Crystalline Polyester in Organic Solvent)

A method of dissolving and recrystallizing the crystalline polyester in an organic solvent is as follows.

Ten (10) g of crystalline polyester and 90 g of an organic solvent are stirred at 70° C. for 1 hr.

After stirred, the solution is cooled at 20° C. for 12 hrs to recrystallize the crystalline polyester.

The organic solvent dispersion of the crystalline polyester after the recrystallization is subject to suction filtration by an aspirator with a Kiriyama funnel and Kiriyama filter No. 4 (from Kiriyama Glass Works Co.) set on the Kiriyama funnel to separate the crystalline polyester from the organic solvent.

The separated and obtained crystalline polyester is dried at 35° C. for 48 hrs to obtain recrystallized matter of crystalline polyester.

Details of constituents of the crystalline polyester resin are described below.

—Polyol—

The polyol is not particularly limited and can be suitably selected to suit to a particular application. Examples are diol and tri- or higher valent alcohol.

A specific example of the diol isa saturated aliphatic diol. Examples of the saturated aliphatic diol arestraight chain saturated aliphatic diol and branched-chain saturated aliphatic diol. Among them, straight chain saturated aliphatic diol is preferable and straight chain saturated aliphatic diol having 2 to 12 carbon atoms is more preferable. When the saturated aliphatic diol has a branched-chain structure, crystallinity of the crystalline polyester resin C may be lowered, which may lower the melting point. When the number of carbon atoms in the saturated aliphatic diol is greater than 12, it may be practically difficult to obtain material. The number of carbon atoms is preferably not greater than 12.

Specific examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol. Among them, ethylene glycol, 1,4-butanediol, 1,6-hexanediol, 1,8-octanediol, 1,10-decanediol, and 1,12-dodecanediol are preferable because crystallinity of the crystalline polyester resin C is high and sharp meltability is excellent.

Specific examples of the tri- or higher valent alcohol include glycerin, trimethylol ethane, trimethylolpropane, pentaerythritol, etc. These may be used alone or in combination.

—Polycarboxylic Acid—

The multivalent carboxylic acid is not particularly limited and can be suitably selected to suit to a particular application. Examples thereof include divalent carboxylic acid and tri- or higher valent carboxylic acid.

Specific examples of the divalent carboxylic acid include saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and and 1,18-octadecanedicarboxylic acid; aromatic dicarboxylic acids of dibasic acid such as phthalic acid, isophthalic acid, terephthalic acid, naphthalene-2,6-dicarboxylic acid, malonic acid, and mesaconic acid; and anhydrides of the foregoing compounds, and lower (having 1 to 3 carbon atoms) alkyl ester of the foregoing compounds.

Specific examples of the tri- or higher valent carboxylic acid include 1,2,4-benzenetricarboxylic acid, 1,2,5-benzenetricarboxylic acid, 1,2,4-naphthalene tricarboxylic acid, anhydrides thereof, and lower (having 1 to 3 carbon atoms) alkyl esters thereof, etc.

Moreover, the polycarboxylic acid may contain, other than the saturated aliphatic dicarboxylic acid and aromatic dicarboxylic acid, dicarboxylic acid containing a sulfonic acid group. Further, the polycarboxylic acid may contain, other than the saturated aliphatic dicarboxylic acid and aromatic dicarboxylic acid, dicarboxylic acid having a double bond. These may be used alone or in combination.

The crystalline polyester resin is preferably composed of a straight chain saturated aliphatic dicarboxylic acid having 4 to 12 carbon atoms and a straight chain saturated aliphatic diol having 2 to 12 carbon atoms.

Namely, the crystalline polyester resin preferably includes a structural unit derived from a saturated aliphatic dicarboxylic acid having 4 to 12 carbon atoms and a structural unit derived from a saturated aliphatic diol having 2 to 12 carbon atoms. As a result of this, the crystalline polyester resin has high crystallinity and excellent sharp meltabilit so that the resultant toner demonstrates excellent low-temperature fixability, which is preferable.

The melting point of the crystalline polyester resin is not particularly limited and can be suitably selected to suit to a particular application. Preferably it is 60° C. to 80° C. When the melting point is lower than 60° C., the crystalline polyester resin tends to melt at low temperatures, which may impair heat resistance storage property of toner. When the melting point thereof is higher than 80° C., the crystalline polyester resin is not fully melted with heat applied during fixing, which may degrade low-temperature fixability.

The molecular weight of the crystalline polyester resin is not particularly limited and can be suitably selected to suit to a particular application. Taking it account that those having a sharp molecular weight distribution and low molecular weight have excellent low-temperature fixability but heat resistance storage property deteriorates as the amount of a low molecular weight component increases, an o-dichlorobenzene soluble component of the crystalline polyester resin preferably has a weight average molecular weight (Mw) of 3,000 to 30,000, a number average molecular weight (Mn) of 1,000 to 10,000, and Mw/Mn of 1.0 to 10, as measured by GPC. Further, it is more preferable that the weight average molecular weight (Mw) thereof be 5,000 to 15,000, the number average molecular weight (Mn) thereof be 2,000 to 10,000, and the Mw/Mn be 1.0 to 5.0.

The acid value of the crystalline polyester resin is not particularly limited and can be suitably selected to suit to a particular application. Preferably, it is not less than 5 mg KOH/g and more preferably not less than 10 mg KOH/g to obtain desired low-temperature fixability in view of affinity between paper and the resin. Meanwhile, it is preferably 45 mg KOH/g or lower to improve hot offset resistance.

A hydroxyl value of the crystalline polyester resin is not particularly limited and can be suitably selected to suit to a particular application. However, it is preferably 0 mg KOH/g to 50 mg KOH/g and more preferably 5 mg KOH/g to 50 mg KOH/g, in order to achieve desired low-temperature fixability and excellent charging property.

The molecular structure of the crystalline polyester resin can be confirmed by solution-state or solid-state NMR, X-ray diffraction, GC/MS, LC/MS, or IR spectroscopy. Simple methods for confirming the molecular structure include a method for detecting, as a crystalline polyester resin, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

The content of the crystalline polyester resin is not particularly limited and can be suitably selected to suit to a particular application. However, it is preferably 3 to 20 parts by mass and more preferably 5 to 15 parts by mass to 100 parts by mass of the toner. When the amount is less than 3 parts by mass, the crystalline polyester resin is not sufficiently sharp melted, which may cause deterioration of low temperature fixability. When it is greater than 20 parts by mass, heat resistance stability property easily deteriorate and fogging of an image may occur. When the amount is within the more preferable range, it is advantageous that all of high image quality and low-temperature fixability is excellent.

<Other Toner Constituents>

Examples of other toner constituents include a release agent, a colorant, a charge controlling agent, an external additive, a fluidity improver, a cleanability improver, and a magnetic material.

Release Agent

Specific examples of the release agent has no particular limit and can be suitably selected among known agents. Specific examples include wax serving as the release agent such as natural wax such as vegetable wax including carnauba wax, cotton wax, Japan wax, and rice wax, animal wax including bees wax and lanolin, mineral wax including ozokelite and ceresine, and petroleum wax including paraffin, microcrystalline, and petrolatum.

Specific examples of the wax other than the natural wax include a synthetic hydrocarbon wax such as Fischer-Tropsch wax, polyethylene wax, and propylene wax and a synthetic wax such as ester, ketone, and ether.

Further, other examples include fatty acid amide-based compounds such as 12-hydroxystearic acid amide, stearic amide, phthalic anhydride imide, and chlorinated hydrocarbons, low-molecular-weight crystalline polymers such as acrylic homopolymers including poly-n-stearyl methacrylate and poly-n-lauryl methacrylate and acrylic copolymers (e.g., n-stearyl acrylate-ethyl methacrylate copolymers), and crystalline polymers having a long alkyl group in a side chain.

Among them, a hydrocarbon wax such as a paraffin wax, a microcrystalline wax, a Fischer-Tropsch wax, a polyethylene wax, and a polypropylene wax is preferable.

The melting point of the release agent is not particularly limited and can be suitably selected to suit to a particular application. Preferably, it is 60° C. to 80° C. When the melting point is lower than 60° C., the release agent tends to melt at low temperatures, which may degrade heat resistance storage property. When the melting point is higher than 80° C., the release agent does not sufficiently melt, thereby causing fixing offset even in the case where the melted resin is in the fixing temperature range, which may result in defects in an image.

The content of the release agent has no particular limit and can be suitably selected to suit to a particular application. Preferably, it is 2 to 10 parts by mass and more preferably 3 to 8 parts by mass to 100 parts by mass of the toner. When the content is less than 2 parts by mass, hot offset resistance and low-temperature fixability during fixing may deteriorate. When the amount is greater than 10 parts by mass, heat resistance storage property may deteriorate and fogging in an image easily occur. When the content is within the more preferable range, it is advantageous to improve image quality and fixing stability.

—Colorant—

The colorant has no particular limit and can be suitably selected to suit to a particular application.

Specific examples include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, parared, filer red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

The content of the colorant is not particularly limited and can be suitably selected to suit to a particular application. Preferably, it is 1 to 15 parts by mass and more preferably 3 to 10 parts by mass to 100 parts by mass of the toner.

The colorant may be used as a master batch in which the colorant forms a composite with a resin. As a resin used in the production of the master batch or a resin kneaded together with the master batch, specific examples other than the amoprphous polyester resins include polymers of styrene or substitution thereof such as polystyrene, poly-p-chlorostyrene, and polyvinyl toluene, styrene-based copolymers such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer, and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used alone or in combination.

The master batch can be prepared by mixing and kneading a colorant with aresin for the master batch. In the mixing and kneading, an organic solvent may be used to improve the interaction between the colorant and the resin. Moreover, a so-called flashing method in which an aqueous paste containing a colorant is mixed and kneaded with a resin and an organic solvent to transfer the colorant to the resin and remove the water and the organic solvent is preferably used because the wet cake of the colorant is used as it is so that it is not necessary to dry the wet cake. In the mixing and kneading, a high-shearing disperser such as a three-roll mill is preferably used.

—Charge Controlling Agent—

The charge controlling agent is not particularly limited and can be suitably selected to suit to a particular application Examples are a nigrosine-based dye, a triphenylmethane-based dye, a chromium-containing metallic complex dye, a molybdic acid chelate pigment, a rhodamine-based dye, alkoxy-based amine, a quaternary ammonium salt (including a fluorine-modified quaternary ammonium salt), alkylamide, a simple substance or a compound of phosphorus, a simple substance or a compound of tungsten, a fluorine-based activator, a salicylic acid metallic salt, a metallic salt of salicylic acid derivative, etc. Specific examples include a nigrosine dye BONTRON 03, a quaternary ammonium salt BONTRON P-51, a metal-containing azo dye BONTRON S-34, an oxynaphthoic acid-based metal complex E-82, a salicylic acid-based metal complex E-84, and a phenol condensate E-89 (all are products of ORIENT CHEMICAL INDUSTRIES CO., LTD.), quaternary ammonium salt molybdenum complexes TP-302 and TP-415 (all are products of Hodogaya Chemical Co., Ltd.); LRA-901, a boron complex LR-147 (product of Japan Carlit Co., Ltd.), a copper phthalocyanine, perylene, quinacridone, an azo-pigment, and polymeric compounds having, as a functional group, a sulfonic acid group, carboxyl group, quaternary ammonium salt, etc.

The content of the charge controlling agent is not particularly limited and can be suitably selected to suit to a particular application. Preferably, it is 0.1 to 10 parts by mass and more preferably 0.2 to 5 parts by mass to 100 parts by mass of the toner. When the amount is greater than 10 parts by mass, the charging ability of the toner excessively increases, which may reduce the effect of the charge controlling agent, increase electrostatic force to a developing roller, leading to low flowability of the developer or low image density of the resulting image. These charge controlling agents may be dissolved and dispersed after being melted and kneaded together with the master batch and/or resin. The charge controlling agents can be, of course, directly added to an organic solvent during dissolution and dispersion. Alternatively, the charge controlling agents may be fixed on the surface of toner particles after the toner particles are manufactured.

—External Additive—

Specific examples of the external additives include hydrophobized silica, titania, titanium oxide, and alumina fine particles. The hydrophobized fine particles can be obtained by treating hydrophilic fine particles with silane coupling agents such as methyltrimethoxy silane, methyltriethoxy silane, and octyltrimethoxy silane.

Specific examples of the hydrophobized silica fine particles include R972, R974, RX200, RY200, 8202, R805, and R812 (all of which is from Nippon Aerosil Co., Ltd., etc.

Specific examples of the hydrophobized titania fine particles include P-25 (from Nippon Aerosil Co., Ltd.), STT-30 and STT-65C-S (from Fuji Titanium Industry Co., Ltd.), TAF-140 (from Fuji Titanium Industry Co., Ltd.), and MT-150W, MT-500B, MT-600B, and MT-150A (from Tayca Corporation).

The content of the external additive is not particularly limited and can be suitably selected to suit to a particular application. Preferably, it is 0.1 to 5 parts by mass and more preferably 0.3 to 3 parts by mass to 100 parts by mass of the toner.

—Cleanability Improver—

The cleanability improver is not particularly limited and can be suitably selected to suit to a particular application so long as it can be added to the toner for the purpose of removing the developer remaining on a photoconductor or a primary transfer member after transferring. Examples are polymer particles produced by soap-free emulsion polymerization, such as polymethyl methacrylate fine particles and polystyrene fine particles. The polymer particles preferably has a relatively narrow particle size distribution and a volume average particle diameter of from 0.01 μm to 1 μm.

—Magnetic Material—

The magnetic material in a case of in which the toner of the present invention is magnetic toner has no particular limit and can be suitably selected to suit to a particular application. Examples are iron powder and ferrite. Of these, white material is preferable in terms of color.

When the Tg1st mentioned above is lower than 20° C., heat resistance storage property deteriorates and blocking in an image developer and filming on a photoconductor occur. When higher than 50° C., low temperature fixability of toner deteriorates. When Tg2nd is below 0° C., blocking resistance of a fixed image (printed matter) may deteriorate. When higher than 30° C., low temperature fixability and gloss may not be fully obtained.

The volume average particle diameter of the toner has no particular limit and can be suitably selected to suit to a particular application. Preferably, it is from 3 μm to 7 μm. In addition, the ratio of the volume average particle diameter to the number average particle diameter is preferably 1.2 or less. In addition, it is preferable to contain a component having a volume average particle diameter of 2 μm or less in an amount of from 1% by number to 10% by number.

<Methods of Calculating and Analyzing Properties of Toner and Toner Constituents>

Each of the Tg, acid value, hydroxyl value, molecular weight, and melting point of each of the amorphous polyester resin, crystalline polyester resin, and release agent may be separately measured. Also, toner may be subjected to gel permeation chromatography (GPC) to separate each component to calculate the SP value, the Tg, the molecular weight, the melting point and the mass ratio of each separated component taking the analyzing method described later.

The weight-average molecular weight Mw of the toner and the resin were measured by a GPC measurer GPC-150C (from Waters Corp.) using THF soluble portion of the resin. KF801 to 807 (from Shodex) is used as the column and an RI (refraction index) detector is used as the detector.

The sample for GPC measuring was prepared in the following manner.

One (1) g of toner is charged in 100 mL of THF and the resulting mixture is stirred for 30 min at 25° C. to obtain a solution in which soluble components are dissolved. The solution is then filtered through a membrane filter having an opening of 0.2 μm to obtain THF soluble matter in the toner. Next, the THF soluble matter is diluted with THF to prepare a sample for measurement by GPC, and the prepared sample is charged in GPC for use in molecular weight measurement of the toner. Separation of each component by GPC can be conducted, for example, by the following method.

In GPC measurement using THF (tetrahydrofuran) as a mobile phase, an eluate is subjected to fractionation by a fraction collector, a fraction corresponding to a part of a desired molecular weight is collected from the total area of an elution curve.

The combined eluate is concentrated and dried by an evaporator, etc, and the solid content is dissolved in a deuterated solvent such as deuterated chloroform and deuterated THF, followed by measurement of $^{1}$H-NMR. From an integral ratio of each element, the ratio of the constituent monomers of the resin in the elution composition is calculated.

As another method, after concentrating the eluate, hydrolysis is conducted with sodium hydroxide, etc. and the ratio of the constituent monomers is calculated by subjecting the decomposed product to qualitative and quantitative analysis by high performance liquid chromatography (HPLC).

Note that, in the case of toner manufacturing where mother toner particles are formed while generating an amorphous polyester resin A through a chain-elongation reaction and/or crosslink reaction of the non-linear reactive precursor and the curing agent, the polyester resin may be separated from actual toner by GPC, etc., to determine the Tg thereof. Alternatively, anamorphous polyester resin may be synthesized through a chain-elongation reaction and/or crosslink reaction of the non-linear reactive precursor and the curing agent to measure the Tg using the synthesized amorphous polyester resin.

<<Separation of Toner Constituents>>

One example of a separation unit for each component during an analysis of the toner is specifically described in detail.

First, 1 g of toner is charged in 100 mL of THF and the resulting mixture is stirred for 30 min at 25° C. to obtain a solution in which soluble components are dissolved.

The solution is thereafter filtered through a membrane filter having an opening of 0.2 μm to obtain THF soluble matter in the toner.

Next, the THF soluble matter is dissolved in THF to prepare a sample for measurement of GPC and the prepared sample is supplied to GPC for use in molecular weight measurement of each resin mentioned above Meanwhile, a fraction collector is disposed at an eluate outlet of GPC, to fraction the eluate per particular count. The eluate is obtained per 5% of the area ratio from the elution onset on the elution curve (rise of the curve).

Next, 30 mg of each eluted fraction as a sample is dissolved in 1 mL of deuterated chloroform and to this solution, 0.05% by volume of tetramethyl silane (TMS) is added as a reference substance.

A glass tube for NMR measuring having a diameter of 5 mm is charged with the solution. A spectrum is obtained by a nuclear magnetic resonance apparatus (JNM-AL 400, product of JEOL Ltd.) by cumulation 128 times at temperature of from 23° C. to 25° C.

The monomer compositions and the compositional ratios of the amorphous polyester resin and the crystalline polyester resin in the toner are determined from peak integral ratios of the obtained spectrum.

For example, peaks are grouped as follows and the component ratio of constitutional monomers is determined using the integral ratio of each of the group.

For example, the peaks can be grouped as follows:

Near 8.25 ppm: derived from the benzene ring of trimellitic acid (corresponding to one hydrogen atom)

Near 8.07 ppm to 8.10 ppm: derived from the benzene ring of terephthalic acid (corresponding to 4 hydrogen atoms)

Near 7.1 ppm to 7.25 ppm: derived from the benzene ring of bisphenol A (corresponding to 4 hydrogen atoms)

Near 6.8 ppm: derived from the benzene ring of bisphenol A (corresponding to 4 hydrogen atoms) and the double bond of fumaric acid (corresponding to 2 hydrogen atoms)

Near 5.2 ppm to 5.4 ppm: derived from methine of an adduct of bisphenol A with propylene oxide (corresponding to one hydrogen atom)

Near 3.7 ppm to 4.7 ppm: derived from methylene of an adduct of bisphenol A with propylene oxide (corresponding to 2 hydrogen atoms) and methylene of an adduct of bisphenol A with ethylene oxide (corresponding to 4 hydrogen atoms)

Near 1.6 ppm: derived from the methyl group of bisphenol A (corresponding to 6 hydrogen atoms)

Based on these results, for example, the abstract collected in a fraction in which the amorphous polyester resin accounts for not less than 90% can be taken as the amorphous polyester resin.

Similarly, the abstract collected in a fraction in which the crystalline polyester resin accounts for not less than 90% can be taken as the crystalline polyester resin.

<<Methods of Measuring Melting Point and Glass Transition Temperature (Tg)>>

In the present invention, melting points and glass transition temperatures (Tg) can be measured by, for example, a differential scanning calorimeter (DSC) system (Q-200, product of TA Instruments Japan Inc.).

Specifically, the melting point and the glass transition temperature of a sample can be measured in the following manner.

First, an aluminum sample container charged with about 5.0 mg of a target sample is placed on a holder unit and the holder unit is set in an electric furnace. Next, the sample is heated (temperature rising for the first time) from −80° C. to 150° C. at a ramp rate of 10° C./min in a nitrogen atmosphere. Thereafter, the sample is cooled down from 150° C. to −80° C. at a ramp rate of −10° C./min and heated (heating for the second time) to 150° C. at a ramp rate of 10° C./min. DSC curves are separately measured for the first temperature rising and the second temperature rising by a differential scanning calorimeter (Q-200, product of TA Instruments Japan Inc.).

The DSC curve for the first temperature rising is selected from the obtained DSC curve to determine the glass transition temperature of the target sample during the first temperature rising using the analysis program installed on the Q-200 system. Similarly, the DSC curve for the second temperature rising is selected and the glass transition temperature of the target sample during the second temperature rising can be determined.

Moreover, the DSC curve for the first temperature rising is selected from the obtained DSC curve and the endothermic peak top temperature of the sample for the first heating can be determined as the melting point of the target sample for the first temperature rising utilizing the analysis program installed on the Q-200 system. Similarly, the DSC curve for the second temperature rising is selected and the endothermic peak top temperature of the sample for the second heating can be determined as the melting point of the target sample for the second temperature rising. In the present specification, the glass transition temperature during the first temperature rising is defined as Tg1st and the glass transition temperature during the second temperature rising is defined as Tg2nd when toner is used as the target sample.

1. Moreover, in the present specification, regarding the glass transition temperature and the melting point of the amorphous polyester resin, the crystalline polyester resin, and the other constituent components such as the release agent, the endothermic peak top temperature and the Tg during the second temperature rising are respectively defined as the melting point and the Tg of each of the target samples unless otherwise specified.

<Toner Production Method>

The method for producing the toner is not particularly limited and may be appropriately selected depending on the intended purpose such as polymerization methods and pulverization methods. The toner is preferably granulated by dispersing an oil phase in an aqueous medium, where the oil phase contains the amorphous polyester resin and the crystalline polyester resin and further contains the release agent, the colorant, etc., if necessary.

Moreover, it is more preferable that the toner be granulated by dispersing an oil phase in an aqueous medium, where the oil phase contains a polyester resin which is a prepolymer including a urethane bond and a urea bond and a polyester including no urethane bond or urea bond as the amorphous polyester resin and the crystalline polyester resin and further contains the curing agent, the release agent, the colorant, etc., if necessary.

One example of such methods for producing the toner is a known dissolution suspension method. As one example of the methods for producing the toner base particle, a method for forming mother toner particles while elongating the amorphous polyester resin through elongation reaction and/or cross-linking reaction between the prepolymer and the curing agent is described hereinafter. This method includes preparing an aqueous medium, preparing an oil phase containing toner material, emulsifying or dispersing the toner material, and removing an organic solvent. Each process is described below.

—Preparation of Aqueous Medium (Aqueous Phase)—

The preparation of the aqueous medium can be carried out by, for example, dispersing resin particles in an aqueous medium. The amount of the resin particles added to the aqueous medium is not particularly limited and may be appropriately selected depending on the intended purpose. Preferably, it is 0.5 parts by mass to 10 parts by mass to 100 parts by mass of the aqueous medium.

The aqueous medium is not particularly limited and may be appropriately selected depending on the intended purpose. Examples are water, a solvent miscible with water, and a mixture thereof. These may be used alone or in combination of two or more thereof. Among them, water is preferable.

The solvent miscible with water is not particularly limited and may be appropriately selected depending on the intended purpose. Examples are alcohol, dimethyl formamide, tetrahydrofuran, cellosolve, and lower ketone. The alcohol is not particularly limited and may be appropriately selected depending on the intended purpose. Examples are methanol, isopropanol, and ethylene glycol. The lower ketone is not particularly limited and may be appropriately selected depending on the intended purpose. Examples are acetone and methyl ethyl ketone.

—Preparation of Oil Phase—

Preparation of the oil phase containing the toner material can be conducted by dissolving or dispersing the toner material in an organic solvent, where the toner material contains, the amorphous polyester resin containing a urethane bond and a urea bond as a prepolymer, the amorphous polyester resin containing no urethane bond or urea bond, and the crystalline polyester resin, and further contains the curing agent, the release agent, the colorant, etc., if necessary.

The organic solvent is not particularly limited and may be appropriately selected depending on the intended purpose, but it is preferably an organic solvent having a boiling point less than 150° C., as removing the organic solvent is easy.

The organic solvent having a boiling point less than 150° C. is not particularly limited and may be appropriately selected depending on the intended purpose. Examples are toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination. Among them, ethyl acetate, toluene, xylene, benzene, methylene chloride, 1,2-dichloroethane, chloroform, and carbon tetrachloride are particularly preferable and ethyl acetate is more preferably used.

—Preparation of Fine Dispersion of Salicylic Acid Derivative Salt—

Methods of finely dispersing a salicylic acid derivative compound in toner include a mechanical method finely dispersing the salicylic acid derivative compound by a beads mill or high-pressure homogenizer, etc. in an oil phase, or in an aqueous phase in the case of an emulsion aggregation method. It is necessary that the salicylic acid derivative compound is dispersed to have a particle diameter not greater than 1 and more preferably not greater than 0.5 μm.

Methods of preparing fine crystals or particles in an oil phase or an aqueous phase include a method of synthesizing the salicylic acid derivative compound in an oil phase. For example, an aqueous solution of an alkyl-substituted salicylic acid derivative and an aqueous solution of a metal salt are put in an oil phase to cause a salt or a complex forming reaction so that a fine zirconium compound can be produced in a toner oil phase. Water or a polar solvent such as alcohol and ether may be put in the oil phase to smoothly proceed the reaction.

—Emulsification or Dispersion—

The emulsification or dispersion of the toner material can be conducted by dispersing the oil phase containing the toner material in the aqueous medium. In the course of the emulsification or dispersion of the toner material, the curing agent and the prepolymer cause a chain-elongation reaction and/or crosslinking reaction.

The reaction conditions (reaction time and temperature) to form the prepolymer are not particularly limited and may be appropriately selected depending on the combination of the curing agent and the prepolymer.

The reaction time is not particularly limited and may be appropriately selected depending on the intended purpose. Preferably, it is from 10 min to 40 hrs and more preferably from 2 to 24 hrs.

The reaction temperature is not particularly limited and may be appropriately selected depending on the intended purpose. Preferably, it is 0° C. to 150° C. and more preferably 30° C. to 50° C.

A method for stably forming the liquid dispersion in the aqueous medium is not particularly limited and may be appropriately selected depending on the intended purpose. An Example is a method for dispersing an oil phase, which is added to an aqueous medium, with shear force, where the oil phase is prepared by dissolving or dispersing toner material in a solvent.

A disperser used for the dispersing is not particularly limited and may be appropriately selected depending on the intended purpose. Examples include a low-speed shearing disperser, a high-speed shearing disperser, a friction disperser, a high-pressure jetting disperser, and an ultrasonic wave disperser.

Among them, the high-speed shearing disperser is preferable because it can control the particle diameters of the dispersion (oil droplets) to the range of from 2 to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose. Preferably, it is 1,000 rpm to 30,000 rpm and more preferably 5,000 rpm to 20,000 rpm.

The dispersion time is not particularly limited and may be appropriately selected depending on the intended purpose. Preferably, it is 0.1 to 5 min in a case of a batch system.

The dispersion temperature is not particularly limited and may be appropriately selected depending on the intended purpose Preferably, it is 0° C. to 150° C. and more preferably 30° C. to 45° C. under pressure. Note that, generally speaking, dispersion can be easily conducted as the dispersion temperature is higher.

The amount of the aqueous medium used for the emulsification or dispersion of the toner material is not particularly limited and may be appropriately selected depending on the intended purpose. Preferably, it is 50 to 2,000 parts by mass and more preferably 100 to 1,000 parts by mass to 100 parts by mass of the toner material.

When the amount of the aqueous medium is less than 50 parts by mass, the dispersion state of the toner material is impaired, which may result in a failure of obtaining mother toner particles having desired particle diameters. When the amount is more than 2,000 parts by mass, the production cost may increase.

When the oil phase containing the toner material is emulsified or dispersed, a dispersant is preferably used for the purpose of stabilizing the dispersion such as oil droplets and obtaining a sharp particle size distribution as well as forming desired shapes of toner particles.

The dispersant is not particularly limited and may be appropriately selected depending on the intended purpose. Examples are a surfactant, a water-insoluble inorganic compound dispersant, and a polymer protective colloid. These may be used alone or in combination. Among them, the surfactant is preferably used.

The surfactant is not particularly limited and may be appropriately selected depending on the intended purpose. Examples are an anionic surfactant, a cationic surfactant, a nonionic surfactant, and an amphoteric surfactant.

The anionic surfactant is not particularly limited and may be appropriately selected depending on the intended purpose. Examples are alkyl benzene sulfonic acid salts, α-olefin sulfonic acid salts, and phosphoric acid esters. Among them, those having a fluoroalkyl group are preferable.

—Removal of Organic Solvent—

A method of removing the organic solvent from the liquid dispersion such as the emulsified slurry is not particularly limited and may be appropriately selected depending on the intended purpose. Examples are a method in which an entire reaction system is gradually heated to evaporate out the organic solvent in the oil droplets and a method in which the dispersion liquid is sprayed in a dry atmosphere to remove the organic solvent in the oil droplets.

As the organic solvent is removed, mother toner particles are formed. The mother toner particles can be subjected to rinsing and drying and can be further subjected to classification. The classification may be carried out in liquid by removing fine particles by a cyclone, a decanter, or a centrifugal separator or may be conducted after drying.

The obtained mother toner particles can be mixed with particles such as the external additive and the charge controlling agent. At this time, by applying a mechanical impact, the external additive can be prevented from fall-off from surfaces of the mother toner particles.

The mechanical impact may be applied by any method without particular limitation and may be properly selected according to a particular purposes. Examples are a method that includes applying an impact to a mixture with a high-speed rotating blade and a method that includes introducing a mixture into a high-speed gas stream and accelerating the gas stream to allow the particles to collide against one another or the particles to collide against a proper collision plate.

A device used for this method is appropriately selected depending on the intended purpose without any limitation and examples are ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

The developer of the present invention contains at least the toner and may further contain appropriately selected other components such as carrier, if necessary.

Accordingly, the developer has excellent transfer properties and charging ability and can stably form high quality images. Note that, the developer may be a one-component developer or a two-component developer. Preferably, it is a two-component developer when it is used in a high speed printer corresponding to recent high information processing speed because the service life thereof can be prolonged. In a case where the developer is used as a one-component developer, the diameters of the toner particles do not significantly change even when the toner is supplied and consumed repeatedly, the toner does not cause filming to a developing roller nor fusion to a layer thickness regulating member such as a blade for thinning the thickness of a toner layer, and provides excellent and stable developing ability and images even when it is stirred in the developing device over a long period of time.

In a case where the developer is used as a two-component developer, the diameters of the toner particles do not significantly change even when the toner is supplied and consumed repeatedly and the toner can provide excellent and stable developing ability and images even when the toner is stirred in the developing device over a long period of time.

<Carrier>

The carrier is appropriately selected depending on the intended purpose without any limitation. Preferably, the carrier has a core and a resin layer covering the core.

—Core—

Material of the core is appropriately selected depending on the intended purpose without any limitation/, Examples are a 50 to 90 emu/g manganese-strontium (Mn—Sr)-based material and a 50 to 90 emu/g manganese-magnesium (Mn—Mg)-based material. To secure a sufficient image density, use of a highly-magnetized material such as iron powder having 100 emu/g or more and magnetite having 75 to 120 emu/g is preferable. Moreover, use of a low-magnetized material such as a 30 to 80 emu/g copper-zinc-based material is preferable because an impact applied to a photoconductor by the developer borne on a bearer in a form of filament can be reduced, which is an advantageous for improving image quality.

These may be used alone or in combination.

A volume-average particle diameter of the core is not particularly limited and may be appropriately selected depending on the intended purpose, but it is preferably 10 to 150 μm, more preferably 40 to 100 μm.

When the volume average particle diameter is less than 10 μm, the proportion of fine particles in carrier particles increases, causing carrier scattering because of low magnetization per carrier particle. When the volume average particle diameter thereof is more than 150 μm, the specific surface area reduces, which may cause toner scattering, causing reproducibility especially in a solid image portion in a full color printing containing many solid image portions.

In a case where the toner is used for a two-component developer, the toner is used by mixing with the carrier.

(Image Forming Apparatus and Image Forming Method)

An image forming apparatus of the present invention includes at least an electrostatic latent image bearer, an electrostatic latent image forming unit, and a developing unit, and if necessary, further includes other units.

An image forming method of the present invention includes at least an electrostatic latent image forming step and a developing step, and if necessary, further includes other steps.

<Electrostatic Latent Image Bearer>

The material, structure, and size of the electrostatic latent image bearer are not particularly limited and may be appropriately selected depending on the intended purpose. Examples of the material thereof include inorganic photoconductors such as amorphous silicon or selenium and organic photoconductors such as polysilane and phthalopolymethine. Among them, amorphous silicon is preferable in terms of long working lifetime.

<Electrostatic Latent Image Forming Unit and Electrostatic Latent Image Forming Step>

The electrostatic latent image forming unit is not particularly limited and may be appropriately selected depending on the intended purpose so long as it is a unit to form an electrostatic latent image on the electrostatic latent image bearer. Examples thereof include a unit including at least a charging member to charge the surface of the electrostatic latent image bearer and an exposing member to imagewise expose the surface of the electrostatic latent image bearer to light.

The electrostatic latent image forming step is not particularly limited and may be appropriately selected depending on the intended purpose so long as it is a step of forming an electrostatic latent image on the electrostatic latent image bearer. The electrostatic latent image forming step can be performed using the electrostatic latent image forming unit by, for example, charging the surface of the electrostatic latent image bearer and then imagewise exposing the surface thereof to light.

<<Charging Member and Charging>>

The charging member is not particularly limited and may be appropriately selected depending on the intended purpose. Examples are contact-type charging devices known per se having, for example, an electrically conductive or semiconductive roller, brush, film, and rubber blade; and non-contact-type charging devices utilizing corona discharge such as corotron and scorotron.

The charging can be conducted by, for example, applying a voltage to the surface of the electrostatic latent image bearer by using the charging member. The charging member may take a form of a magnetic brush or a fur brush other than a roller. The form of the charging member may be suitably selected according to the specification or configuration of the image forming apparatus.

The charging member is not limited to the aforementioned contact-type charging members. However, the contact-type charging member is preferably used to obtain an image forming apparatus having a charging member producing a less amount of ozone.

<<Irradiation Member and Irradiation>>

The irradiation member is not particularly limited and may be appropriately selected depending on the purpose so long as it attains desired imagewise irradiation on the surface of the electrophotographic latent image bearer charged with the charging member. Examples are various irradiation members such as a copy optical irradiation device, a rod lens array irradiation device, a laser optical irradiation device, and a liquid crystal shutter irradiation device.

A light source used for the irradiation member is not particularly limited and may be appropriately selected depending on the intended purpose. Examples are conventional light-emitting devices such as a fluorescent lamp, a tungsten lamp, a halogen lamp, a mercury lamp, a sodium lamp, a light-emitting diode (LED), a laser diode (LD), and an electroluminescence (EL) device.

Also, various filters may be used for emitting only light having a desired wavelength range. Examples are a sharp-cut filter, a band-pass filter, an infrared cut filter, a dichroic filter, an interference filter, and a color temperature conversion filter.

The irradiation can be conducted by, for example, imagewise irradiating the surface of the electrostatic latent image bearer with light using the irradiation member.

In the present invention, light may be imagewise applied from the backside of the electrostatic latent image bearer.

<Developing Unit and Developing Step>

The developing unit is not particularly limited and may be appropriately selected depending on the intended purpose so long as it is a developing unit containing toner for developing the electrostatic latent image formed on the electrostatic latent image bearer to form a visible image.

The developing step is not particularly limited and may be appropriately selected depending on the intended purpose so long as it is a step of developing the electrostatic latent image formed on the electrostatic latent image bearer with toner to form a visible image. The developing step can be conducted by the developing unit. The developing unit is preferably a developing device including a stirring device for triboelecrically charging the tone, a magnetic field-generating unit fixed inside and a rotatable developer bearing member to bear a developer containing the toner on the surface thereof.

<<<Developer>>>

The developer of the present invention contains at least the toner and may further contain appropriately selected other components such as carrier, if necessary.

It is preferably a two-component developer when it is used in a high speed printer corresponding to recent high information processing speed because the service life thereof can be prolonged.

<<<Carrier>>>

The carrier is appropriately selected depending on the intended purpose without any limitation. Preferably, the carrier contains a core and a resin layer covering the core.

Material of the core is appropriately selected depending on the intended purpose without any limitation and examples thereof include a 50 to 90 emu/g manganese-strontium (Mn—Sr)-based material and a 50 to 90 emu/g manganese-magnesium (Mn—Mg)-based material. To secure a sufficient image density, use of a hard magnetic material such as iron powder (100 emu/g or more), and magnetite (75 to 120 emu/g) is preferable. Moreover, use of a soft magnetic material such as a 30 to 80 emu/g copper-zinc material is preferable because an impact applied to a photoconductor by the developer born on a bearer in the form of a brush can be reduced, which is an advantageous for improving image quality.

A volume-average particle diameter of the core material is not particularly limited and may be appropriately selected depending on the intended purpose, but it is preferably 10 to 150 μm, more preferably 40 to 100 μm.

When the volume average particle diameter thereof is less than 10 μm, the proportion of particles in the distribution of carrier particle diameters increases, causing carrier scattering because of low magnetization per carrier particle. When the volume average particle diameter thereof is more than 150 μm, the specific surface area reduces, which may cause toner scattering, causing reproducibility especially in a solid image portion in a full color printing containing many solid image portions.

In the case where the toner is used for a two-component developer, the toner is used by mixing with the carrier. The amount of the carrier in the two-component developer is not particularly limited and may be appropriately selected depending on the intended purpose. Preferably, it is 90 to 98 parts by mass and more preferably 93 to 97 parts by mass to 100 parts by mass of the two-component developer.

The developer of the present invention may be suitably used in image formation by various known electrophotographic methods such as a magnetic one-component developing method, a non-magnetic one-component developing method, and a two-component developing method.

In the developing unit, toner and carrier are stirred and mixed so that the toner particles are charged by friction generated therebetween. The charged toner particles are retained like a filament on the surface of the rotating magnetic roller to form magnetic brushes. The magnetic roller is disposed proximately to the electrostatic latent image developing member and some of the toner particles forming the magnetic brushes on the magnet roller are transferred onto the surface of the electrostatic latent image developing member by the action of electrically attractive force. As a result, the electrostatic latent image is developed with the toner to form a visible toner image on the surface of the electrostatic latent image developing member.

<Other Units and Other Steps>

Examples of the other units include a transfer unit, a fixing unit, a cleaning unit, a charge-eliminating unit, a recycling unit, and a controlling unit.

Examples of the other step are a transfer step, a fixing step, a cleaning step, a charge-eliminating step, a recycling step, and a controlling step.

<<Transfer Unit and Transfer Step>>

The transfer unit is not particularly limited and may be appropriately selected depending on the intended purpose so long as it is a unit to transfer the visible image onto a recording medium. Preferably, the transfer unit includes a primary transfer unit to transfer the visible images to an intermediate transfer member to form a composite transfer image and a secondary transfer unit to transfer the composite transfer image onto a recording medium.

The transfer step is not particularly limited and may be appropriately selected depending on the intended purpose so long as it is a step of transferring the visible image onto a recording medium. Preferably, the visible images are primarily transferred to an intermediate transfer member and the thus-transferred visible images are secondarily transferred to the recording medium.

For example, the transfer step can be conducted using the transfer unit by charging the photoconductor with a transfer charger to transfer the visible image.

Here, when the image to be secondarily transferred onto the recording medium is a color image of several color toners, a configuration can be employed in which the transfer unit sequentially superposes the color toners on top of another on the intermediate transfer member to form an image on the intermediate transfer member and the image on the intermediate transfer member is secondarily transferred at once onto the recording medium by the intermediate transfer unit.

The intermediate transfer member is not particularly limited and may be appropriately selected from known transfer members depending on the intended purpose. A suitable example is a transferring belt.

The transfer unit (including the primary- and secondary transfer units) preferably includes at least a transfer device which peeling-charges the visible images formed on the photoconductor from the photoconductor onto the recording medium. Examples of the transfer device area corona transfer device employing corona discharge, a transfer belt, a transfer roller, a pressing transfer roller, and an adhesive transferring device.

The recording medium is typically plain paper but not particularly limited thereto and may be appropriately selected depending on the purpose, so long as it can receive a developed, unfixed image. An example of the recording medium is a PET base for transparent sheet.

<<Fixing Unit and Fixing Step>>

The fixing unit is not particularly limited and may be appropriately selected depending on the intended purpose as long as it is a unit to fix a transferred image which has been transferred on the recording medium. Known heating-pressurizing members are preferable. Examples include a combination of a heat roller and a press roller and a combination of a heat roller, a press roller, and an endless belt.

The fixing step is not particularly limited and may be appropriately selected depending on the intended purpose, as long as it is a step of fixing a visible image which has been transferred onto the recording medium. The fixing step may be conducted every time an image of each color toner is transferred onto the recording medium or at once at the same time on a laminated image of color toners.

The fixing step can be performed by the fixing unit.

The heating-pressurizing member usually conducts heating preferably at 80° C. to 200° C.

Notably, in the present invention, known photofixing devices may be used instead of or in addition to the fixing unit depending on the intended purpose.

The surface pressure in the fixing step is not particularly limited and may be appropriately selected depending on the intended purpose. Preferably, it is 10 to 80 $N/cm^2$.

<<Cleaning Unit and Cleaning Step>>

The cleaning unit is not particularly limited and may be appropriately selected depending on the intended purpose, as long as it can remove the toner remaining on the photoconductor. Examples are a magnetic brush cleaner, an electrostatic brush cleaner, a magnetic roller cleaner, a blade cleaner, a brush cleaner and a web cleaner.

The cleaning step is not particularly limited and may be appropriately selected depending on the intended purpose, as long as the toner remaining on the photoconductor can be removed in the step. For example, it may be conducted by the cleaning unit.

<<Charge-Eliminating Unit and Charge-Eliminating Step>>

The charge-eliminating unit is not particularly limited and may be appropriately selected depending on the intended purpose, as long as it is a unit to apply a charge-eliminating bias to the photoconductor to charge-eliminate. Examples include a charge-eliminating lamp.

The charge-eliminating step is not particularly limited and may be appropriately selected depending on the intended purpose, as long as it is a step of applying a charge-eliminating bias to the photoconductor to charge-eliminate. It may be carried out by the charge-eliminating unit.

<<Recycling Unit and Recycling Step>>

The recycling unit is not particularly limited and may be appropriately selected depending on the intended purpose, as long as it is a unit to recycle the toner which has been removed in the cleaning step to the developing device. For example, a known conveying unit can be used.

The recycling step is not particularly limited and may be appropriately selected depending on the intended purpose, as long as it is a step of recycling the toner which has been removed in the cleaning step to the developing device. The recycling step can be conducted by the recycling unit.

An embodiment of the method of forming an image using the image forming apparatus of the present invention is explained with reference to FIG. 1.

An image forming apparatus 1 is a printer. The image forming apparatus is not particularly limited if it is capable of forming images with toner such as copiers, facsimiles, and multifunctional machines.

The image forming apparatus 1 includes a paper feeder 210, a conveyor 220, an image former 230, a transferer 240, and a fixer 250.

The paper feeder 210 includes a paper feed cassette 211 having a stack of paper P to be fed and a paper feed roller 212 to feed one piece by one piece of the papers P stack in the paper feed cassette 211.

The conveyor 220 includes a roller 221 conveying the paper P fed by the paper feed roller 212 toward the transferer 240, a pair of timing rollers 222 standing-by while pinching the front end of the paper P fed by the roller 221 and feeding the paper to the transferer 240 at a predetermined timing, and a paper ejection roller 223 ejecting the paper P on which a color toner image is fixed to a paper discharge tray 224.

The image former 230 includes an image forming unit Y using a developer having a yellow toner with which an image is formed, an image forming unit C using a developer having a cyan toner, an image forming unit M using a developer having a magenta toner, and an image forming unit K using a developer having a black toner in this order from left to right with a predetermined interval in the drawing and an irradiator 233.

An arbitrary image forming unit among the image forming units (Y, C. M, and K) is simply referred to as the image forming unit.

The developer includes toner and carrier.

The four image forming units (Y, C, M, and K) only use developers different from each other and substantially have the same mechanical configurations.

The transferer 240 includes a drive roller 241, a driven roller 242, an intermediate transfer belt 243 rotatable anticlockwise as the drive roller 241 drives, first transfer rollers (244Y, 244C, 244M, and 244K) facing a photoconductor drum 231 with the intermediate transfer belt 243 therebetween, and a second facing roller 245 and a second transfer roller 246 opposite to each other with the intermediate transfer belt 243 therebetween at the transfer position where a toner image is transferred to paper.

The fixer 250 includes a heater inside a fixing belt 251 heating the paper P, and a pressure roller 252 rotatably pressuring the fixing belt 251 to form a nip, which applies heat and pressure to a color toner image on the paper P so that the color toner image is fixed thereon. The paper P on which the color toner image is fixed is ejected onto the paper ejection tray 224 by the paper ejection roller 223 to complete the series of image forming processes.

(Toner Housing Unit)

The toner housing unit in the present invention is a unit which is capable of housing toner and accommodates toner.

Specific examples include toner housing containers, image developers, and process cartridges.

The toner housing container a vessel accommodating toner.

The image developer means a device to accommodate toner and develop images.

The process cartridge integrally includes at least an image bearer and an image developer and accommodates toner, which is detachably attachable to an image forming apparatus. The process cartridge may further include at least one of a charger, an irradiator, and a cleaner.

When the toner housing unit is mounted on an image forming apparatus, a low-cost toner having excellent durability, low-temperature fixability, pulverizability during manufacturing of toner, blocking resistance, and filming resistance of the present invention forms an image. Therefore, quality images can be produced at low cost.

<Process Cartridge>

The process cartridge of the present invention is manufactured so as to be mountable on various image forming apparatuses in an attachably detachable manner, including at least an electrostatic latent image bearer to bear an electrostatic latent image thereon and a developing unit to form a toner image by developing the electrostatic latent image borne on the electrostatic latent image bearer with a developer of the present invention. Note that, the process cartridge of the present invention may further include other units, if necessary.

The developing unit includes at least a developer accommodating container to accommodate the developer of the present invention and a developer bearing member to bear and convey the developer accommodated in the developer accommodating container. Note that, the developing unit may further include a regulating member etc. in order to regulate the thickness of the developer borne thereon.

Figure 2:
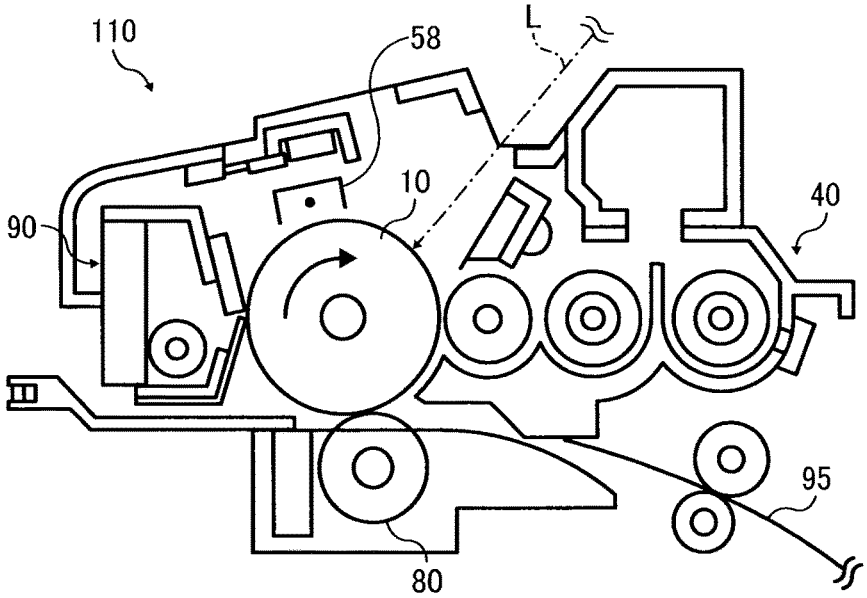
FIG. 2 A cross-section illustrating a process cartridge which is an embodiment of the toner housing unit of the present invention.

FIG. 2 is a diagram illustrating one example of the process cartridge relating to the present invention. A process cartridge 110 includes a photoconductor drum 10, a corona charging device 58, a developing device 40, a transfer roller 80, and a cleaning device 90.

EXAMPLES

Examples of the present invention are described below but the present invention is not limited thereto.

Each measuring value in Examples below was measured according to the method described in the specification.

Production Example 1

<Synthesis of Amorphous Polyester Resin A1>

A reaction vessel equipped with a condenser, a stirring device, and a nitrogen-introducing tube was charged with 20.3 parts of terephthalic acid, 8.7 parts of isophthalic acid, 40.8 parts of an adduct of bisphenol A with 2.2 mol of ethylene oxide, 30.2 parts of an adduct of bisphenol A with 2.2 mole of propylene oxide and 0.2 parts of dibutyltin oxide. The resultant mixture was caused to react at 230° C. for 4 hours under normal pressure and continue reaction for 5 hours under a reduced pressure of from 10 to 15 mmHg to obtain an [amorphous polyester resin A1].

Production Example 2

<Synthesis of Amorphous Polyester Resin A2>

A reaction vessel equipped with a condenser, a stirring device, and a nitrogen-introducing tube was charged with 25.8 parts of terephthalic acid, 27.8 parts of adipic acid, 44.9 parts of 3-methyl-1, 5-pentanediol, 1.5 parts of trimethylolpropane, and 0.2 parts of dibutyltin oxide. The resultant mixture was caused to react at 230° C. for 4 hours under normal pressure and continue reaction for 5 hours under a reduced pressure of from 10 to 15 mmHg to obtain an intermediate amorphous polyester resin. Further, 2.0 parts of trimellitic acid was added to the mixture to cause reaction for 5 hours under a reduced pressure of from 10 to 15 mmHg to obtain an [amorphous polyester resin A2].

Production Example 3

<Synthesis of Amorphous Polyester Resin A3>

A reaction vessel equipped with a condenser, a stirring device, and a nitrogen-introducing tube was charged with 90 parts of the intermediate amorphous polyester resin obtained in production Example 2 and 10 parts of isophorone diisocyanate (IPDI). The resultant mixture was diluted with 100 parts of ethyl acetate to cause reaction at 80° C. for 5 hrs to obtain an amorphous polyester resin A3, which was a prepolymer and an ethyl acetate solution including solid contents of 50%.

Production Example 4

<Synthesis of Crystalline Polyester Resin B>

A 5 L four-necked flask equipped with a nitrogen-introducing tube, a dehydration tube, a stirring device, and a thermocouple was charged with dodecanedioic acid ethylene glycol such that the molar ratio of hydroxyl group to carboxyl group OH/COOH was 0.9. Moreover, titanium tetraisopropoxide (500 ppm relative to the resin component) was added thereto and the resultant mixture was caused to conduct reaction at 180° C. for 10 hrs and thereafter heated to 200° C. to conduct reaction for 3 hrs. Further, the resultant was caused to conduct reaction at 8.3 kPa for 2 hrs to obtain a [crystalline polyester resin B].

Properties of the amorphous polyester resins A1, A2, and A3 and the crystalline polyester resin B are shown in Table 1.

TABLE 1

| | Melting point (° C.) | Tg (° C.) | Mw | Mn | Mw/Mn | Acid value (mg KOH/g) | Hydroxyl value (mg KOH/g) |
|---|---|---|---|---|---|---|---|
| Resin A1 | — | 64.3 | 7500 | 2900 | 2.6 | 5.2 | 6.2 |
| Resin A2 | — | −35.8 | 18300 | 5800 | 3.2 | 26.3 | 2.3 |
| Resin A3 | — | −26 | 58000 | 7000 | 8.3 | 0.8 | 0.2 |
| Resin B | 76.6 | — | 28000 | 6100 | 4.6 | 8.3 | 4.4 |

<Preparation of Masterbatch (MB)>

Water (600), 500 parts of carbon black (NIPEX 60 from Degussa), and 500 parts of the [amorphous polyester resin A1] were added and mixed together by HENSCHEL MIXER (product of NIPPON COKE & ENGINEERING CO., LTD.) and the resultant mixture was kneaded by a two roll mill for 30 min at 150° C. The kneaded product was rolled out and cooled, followed by pulverizing by a pulverizer to obtain [masterbatch 1].

<Synthesis of Organic Fine Particle Emulsion (Fine Particle Dispersion)>

A reaction vessel equipped with a stirring bar and a thermometer was charged with 683 parts of water, 11 parts of a sodium salt of sulfuric acid ester of an adduct of methacrylic acid with ethylene oxide (ELEMINOL RS-30, product of Sanyo Chemical Industries, Ltd.), 138 parts of styrene, 138 parts of methacrylic acid, and 1 part of ammonium persulfate. The resultant mixture was stirred for 15 min at 400 rpm to obtain a white emulsion. The obtained emulsion was heated to have the system temperature of 75° C. to cause reaction for 5 hrs. To the resultant mixture, 30 parts of a 1% ammonium persulfate aqueous solution was added, followed by aging for 5 hrs at 75° C., to obtain an aqueous dispersion of a vinyl-based resin (a copolymer of styrene/methacrylic acid/sodium salt of sulfuric acid ester of an adduct of methacrylic acid with ethylene oxide), i.e., a [fine particle dispersion].

The [fine particle dispersion] was measured by LA-920 (product of HORIBA, Ltd.) and as a result, the volume-average particle diameter was found to be 0.14 μm.

<Preparation of Liquid Dispersion of Crystalline Polyester Resin B>

A vessel equipped with a stirring bar and a thermometer was charged with 100 parts of the crystalline polyester resin B and 400 parts of ethyl acetate, followed by heating to 80° C. during stirring. The temperature was maintained at 80° C. for 5 hrs, followed by cooling to 20° C. in 1 hr. The resultant mixture was dispersed by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to obtain a [liquid dispersion of crystalline polyester resin] including solid contents of 20%.

<Preparation of WAX Liquid Dispersion>

A vessel equipped with a stirring bar and a thermometer was charged with 100 parts of ester wax (WEP-3 having a melting point of 70° C. and an acid value of 0.1 mgKOH/g from NOF Corp.) as release agent and 400 parts of ethyl acetate, followed by heating to 80° C. during stirring. The temperature was maintained at 80° C. for 5 hrs, and thereafter the mixture was cooled to 20° C. in 1 hr. The resultant mixture was dispersed by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to obtain a [WAX liquid dispersion] including solid contents of 20%.

<Preparation of Salicylic Acid Derivative Zirconium Salt Liquid Dispersion 1>

A vessel equipped with a stirring bar and a thermometer was charged with 50 parts of 1,3-di-t-zirconiumbutylsalicylate (SZr), 50 parts of the amorphous polyester resin A1, and 400 parts of ethyl acetate, followed by heating to 30° C. during stirring.

The temperature was maintained at 30° C. for 1 hr. Thereafter the mixture was cooled to 20° C. in 1 hr. The resultant mixture was dispersed by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 10 passes, to obtain a [1,3-di-t-zirconiumbutylsalicylate liquid dispersion 1] including solid contents of 20%. The dispersion was measured by LA-920 (product of HORIBA, Ltd.) and as a result, the volume-average particle diameter was 0.25 μm.

<Preparation of Salicylic Acid Derivative Zirconium Salt Liquid Dispersion 2>

The procedure for preparation of the above [1,3-di-t-zirconiumbutylsalicylate dispersion 1] was repeated except for changing 10 passes to 3 passes in the conditions of dispersing the mixture to prepare a [1,3-di-t-zirconiumbutylsalicylate (SZr) liquid dispersion 2] including solid contents of 20%. The liquid dispersion was measured by LA-920 (product of HORIBA, Ltd.), and as a result, the volume-average particle diameter thereof was 1.05 μm.

(Oil Water Distribution Test)

A screw vial was charged with 30 parts of the thus-obtained (SZr) dispersion 1 and thus-obtained (SZr) dispersion 2 and 70 parts of ion-exchanges water, followed by shaking with a shaker for 1 hr. After the mixture was left for 3 hrs, separation of a clouded phase including 1,3-di-t-zirconiumbutylsalicylate and a transparent phase of water was clearly observed.

Meanwhile, a screw vial was charged with 3 parts of 1,3-di-t-zirconiumbutylsalicylate and 27 parts of ethyl acetate, followed by stirring and mixing for 1 hr. Then, the screw vial was charged with 70 parts of ion-exchanged water, followed by shaking with a shaker for 1 hr. After the mixture was left for 3 hrs, a clouded water phase including 1,3-di-t-zirconiumbutylsalicylate and a transparent phase of ethyl acetate were observed. This proved 1,3-di-t-zirconiumbutylsalicylate was not released from the SZr liquid dispersion into the water phase.

<Preparation of Salicylic Acid Derivative Aluminum Salt Dispersion>

The procedure for preparation of the above [1,3-di-t-zirconiumbutylsalicylate dispersion 1] was repeated except for replacing 50 parts of 1,3-di-t-zirconiumbutylsalicylate (SZr) with 50 parts of 1,3-di-t-aluminumbutylsalicylate (SAl) to prepare a [1,3-di-t-aluminumbutylsalicylate liquid dispersion (SAl)] including solid contents of 20%. The liquid dispersion had a volume-average particle diameter of 0.29 μm.

<Preparation of Salicylic Acid Derivative Iron Salt Liquid Dispersion>

The procedure for preparation of the above [1,3-di-t-zirconiumbutylsalicylate dispersion 1] was repeated except for replacing 50 parts of 1,3-di-t-zirconiumbutylsalicylate (SZr) with 50 parts of 1,3-di-t-ironbutylsalicylate (SFe) to prepare a [1,3-di-t-ironbutylsalicylate liquid dispersion (SFe)] including solid contents of 20%. The liquid dispersion had a volume-average particle diameter of 0.23 μm.

<Preparation of Salicylic Acid Derivative Zinc Salt Dispersion>

The procedure for preparation of the above [1,3-di-t-zirconiumbutylsalicylate dispersion 1] was repeated except for replacing 50 parts of 1,3-di-t-zirconiumbutylsalicylate (SZr) with 50 parts of 1,3-di-t-zincbutylsalicylate (SZn) to prepare a [1,3-di-t-aluminumbutylsalicylate dispersion (SZn)] including solid contents of 20%. The dispersion had a volume-average particle diameter of 0.31 μm.

Each of the SAl liquid dispersion, SFe liquid dispersion, and SZn dispersion was subjected to oil water distribution test to prove the salicylic acid derivative metal salt was not released from the dispersion into the water phase.

Example 1

<Preparation of Aqueous Phase>

Water (312 parts), 11 parts of the [fine particle dispersion], 11 parts of a 48.5% aqueous solution of sodium dodecyl diphenyl ether disulfonate (ELEMINOL MON-7, product of Sanyo Chemical Industries Ltd.), and 28 parts of ethyl acetate were mixed and stirred to obtain an opaque white liquid. The obtained liquid was used as [aqueous phase].

<Preparation of Oil Phase>

A vessel was charged with 89 parts of ethyl acetate, 25 parts of the [WAX liquid dispersion], 92 parts of the [amorphous polyester resin A1], 8 parts of the [amorphous polyester resin A2], 16 parts of the [masterbatch 1] and 20 parts of the [SZr liquid dispersion 1], followed by mixing using a TK Homomixer (product of PRIMIX Corp.) at 5,000 rpm for 60 min to obtain [oil phase].

<Emulsification • Removal of Solvent>

A container including the [aqueous phase] was charged with the [oil phase] and the resultant mixture was mixed by a TK Homomixer at 13,000 rpm for 3 min to obtain an [emulsified slurry].

A container equipped with a stirrer and a thermometer was charged with the [emulsified slurry], followed by removing the solvent therein at 30° C. for 8 hrs to obtain a [dispersion slurry].

<Washing • Drying>

100 parts of the [dispersion slurry 1] was subject to filtration under a reduced pressure and the following treatment.

(1): ion-exchanged water (100 parts) was added to the filtration cake, followed by mixing with a TK Homomixer (at 12,000 rpm for 10 min) and the mixture was filtrated;

(2): one hundred (100) parts of 10% aqueous sodium hydroxide solution was admixed with the filtration cake obtained in (1) using a TK Homomixer (at 12,000 rpm for 30 min) and the resultant mixture was filtrated under a reduced pressure;

(3): one hundred (100) parts of 10% hydrochloric acid was admixed with the filtration cake obtained in (2) using a TK Homomixer (at 12,000 rpm for 10 min) and the mixture was filtrated; and (4): ion-exchanged water (300 parts) was admixed with the filtration cake obtained in (3) using a TK Homomixer (at 12,000 rpm for 10 min) and the mixture was filtrated. The above steps (1) to (5) were repeated twice to prepare a filtration cake. Further, ion-exchanged water was admixed with the filtration cake to include solid contents of 50% using a TK Homomixer (at 12,000 rpm for 10 min) to obtain a toner slurry liquid.

Next, the liquid was dried with an air-circulating drier at 45° C. for 48 hrs and thereafter was caused to pass through a sieve with a mesh size of 75 μm to obtain [mother toner particle H1]. One hundred (100) parts of the [mother toner particle H1] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer and the resultant mixture was screened by a sift having a mesh size of 25 μm to obtain toner of Example 1.

Examples 2 to 13 and Comparative Example 1 to 5

The preparation of the toner in Example 1 was repeated except for changing charge-in quantity according to Table 2 to obtain toners of Examples 2 to 13 and Comparative Example 1 to 5. SZr dispersion was not used in Comparative Example 3 to 5.

Example 14

<Preparation of Aqueous Phase>

Water (312 parts), 11 parts of the [fine particle liquid dispersion], 11 parts of a 48.5% aqueous solution of sodium dodecyl diphenyl ether disulfonate (ELEMINOL MON-7, product of Sanyo Chemical Industries Ltd.), and 28 parts of ethyl acetate were mixed and stirred to obtain an opaque white liquid. The obtained liquid was used as [aqueous phase].

<Preparation of Oil Phase>

A vessel was charged with 89 parts of ethyl acetate, 25 parts of the [WAX liquid dispersion], 88 parts of the [amorphous polyester resin A1], 12 parts of the [amorphous polyester resin A2], and 16 parts of the [masterbatch 1], followed by mixing using a TK Homomixer (product of PRIMIX Corp.) at 5,000 rpm for 60 min to obtain a wax and pigment liquid dispersion in an ethyl acetate resin solution.

(Synthesis of Zirconium Compound in Dispersion)

A solution in which 0.39 parts of zirconium oxychloride (8 hydrates) were dissolved in 5 parts of ion-exchanged water was added to the ethyl acetate liquid dispersion while stirred at 600 rpm by a three-one motor. Meanwhile, 0.61 parts of 1,3-di-t-butylsalicylate were dissolved in 5 parts of 1% caustic soda. The solution was gradually added to the dispersion in 30 min to synthesize a zirconium compound in an oil phase.

The oil phase was emulsified, de-solvented, washed, dried, and mixed with inorganic fine particles in the same manner as in Example 1 to obtain toner of Example 14.

Example 15

The procedure for preparation of the toner in Example 14 was repeated except for doubling the amount of Synthesis of Zirconium Compound in Liquid Dispersion in the liquid dispersion of the zirconium compound in the oil phase to obtain toner of Example 15.

A solution in which 0.78 parts of zirconium oxychloride (8 hydrates) were dissolved in 10 parts of ion-exchanged water was added to the ethyl acetate dispersion obtained in Example 14 while stirred at 600 rpm by a three-one motor. Meanwhile, 1.22 parts of 1,3-di-t-butylsalicylate were dissolved in 10 parts of 1% caustic soda. The solution was gradually added to the dispersion in 60 min to synthesize a zirconium compound in an oil phase.

The oil phase was emulsified, de-solvented, washed, dried, and mixed with inorganic fine particles in the same manner as in Example 1 to obtain toner of Example 15.

Example 16

The procedure for preparation of the toner in Example 14 was repeated except for tripling the amount of Synthesis of Zirconium Compound in Dispersion in the liquid dispersion of the zirconium compound in the oil phase to obtain toner of Example 16.

A solution in which 1.17 parts of zirconium oxychloride (8 hydrates) were dissolved in 15 parts of ion-exchanged water was added to the ethyl acetate dispersion obtained in Example 14 while stirred at 600 rpm by a three-one motor. Meanwhile, 1.83 parts of 1,3-di-t-butylsalicylate were dissolved in 15 parts of 1% caustic soda. The solution was gradually added to the dispersion in 90 min to synthesize a zirconium compound in an oil phase.

<Preparation of Oil Phase>

A vessel was charged with 89 parts of ethyl acetate, 25 parts of the [WAX liquid dispersion], 96 parts of the [amorphous polyester resin A1], 4 parts of the [amorphous polyester resin A2], 16 parts of the [masterbatch 1], and 20 parts of [S(Zr) liquid dispersion] followed by mixing using a TK Homomixer (product of PRIMIX Corp.) at 5,000 rpm for 60 min to obtain an [oil phase].

The [oil phase] was emulsified, de-solvented, washed, dried, and mixed with inorganic fine particles in the same manner as in Example 1 to obtain toner of Example 16.

Example 17

<Preparation of Oil Phase>

A vessel was charged with 49 parts of ethyl acetate, 25 parts of the [WAX liquid dispersion], 78 parts of the [amorphous polyester resin A1], 12 parts of the [amorphous polyester resin A2], 50 parts of the [crystalline polyester resin B liquid dispersion], and 16 parts of the [masterbatch 1], followed by mixing using a TK Homomixer (product of PRIMIX Corp.) at 5,000 rpm for 60 min to obtain an [oil phase].

(Synthesis of Zirconium Compound in Liquid Dispersion)

A solution in which 0.39 parts of zirconium oxychloride (8 hydrates) were dissolved in 5 parts of ion-exchanged water was added to the ethyl acetate liquid dispersion while stirred at 600 rpm by a three-one motor. Meanwhile, 0.61 parts of 1,3-di-t-butylsalicylate were dissolved in 5 parts of 1% caustic soda. The solution was gradually added to the dispersion in 30 min to synthesize a zirconium compound in an oil phase.

The oil phase was emulsified, de-solvented, washed, dried and mixed with inorganic fine particles in the same manner of Example 1 to obtain a toner of Example 17.

Storage modulus of the obtained toners during temperature rising and during temperature falling are shown in Table 3.

Example 18

The procedure for preparation of the toner in Example 2 was repeated except for replacing the [salicylic acid derivative zirconium salt dispersion 1] with the [salicylic acid derivative zirconium salt dispersion 2] to obtain toner of Example 18.

Comparative Example 6

The procedure for preparation of the toner in Example 2 was repeated until preparing the [emulsified slurry]. Thereafter, a container equipped with a stirrer and a thermometer was charged with the [emulsified slurry] followed by removing the solvent therein at 80° C. for 2 hrs to obtain a [dispersion slurry].

<Rinsing • Drying>

After 100 parts of the [dispersion slurry] was filtrated under a reduced pressure, (1): ion-exchanged water (100 parts) was added to the filtration cake, followed by mixing with a TK Homomixer (at 12,000 rpm for 10 min), and then the mixture was filtrated;

(2): one hundred (100) parts of 10% aqueous sodium hydroxide solution was added to the filtration cake obtained in (1), followed by mixing with a TK Homomixer (at 12,000 rpm for 30 min), and thereafter the resultant mixture was filtrated under a reduced pressure;

(3): one hundred (100) parts of 10% by weight hydrochloric acid was added to the filtration cake obtained in (2), followed by mixing with a TK Homomixer (at 12,000 rpm for 10 min) and then the mixture was filtrated; and (4): ion-exchanged water (300 parts) was added to the filtration cake obtained in (3), followed by mixing with a TK Homomixer (at 12,000 rpm for 10 min) and then the mixture was filtrated. The above steps (1) to (5) were repeated twice to prepare a filtration cake. Further, ion-exchanged water was added to the filtration cake to include solid contents of 50%, followed by mixing with a TK Homomixer (at 12,000 rpm for 10 min) to obtain a toner slurry liquid.

The slurry liquid was filtrated and thereafter, the liquid was dried with an air-circulating drier at 45° C. for 48 hrs and thereafter was caused to pass through a sieve with a mesh size of 75 μm, to obtain [mother toner particle]. One hundred (100) parts of the [mother toner particle] were mixed with 1.0 part of NX-90S from Nippon Aerosil Co., Ltd., 1.0 part of JMT-150IB from Tayca Corp., and 1.0 part of the HSP-160A from Fuso Chemical Co., Ltd. by a Henschel mixer, and sieved by a sift having a mesh size of 25 μm to obtain toner of Comparative Example 6.

The toner had a Tg of 52° C. Therefore, the de-solvent process was conducted at Tg+28° C.

TABLE 2

(1)

| | | Resin A1 (part) | Resin A2 (part) | Resin A3 (part) | Resin B (part) |
|---|---|---|---|---|---|
| | Comparative Example 1 | 96 | 4 | | |
| Example 1 | | 92 | 8 | | |
| Example 2 | | 88 | 12 | | |
| Example 3 | | 84 | 16 | | |
| | Comparative Example 2 | 80 | 20 | | |
| Example 4 | | 88 | | 12(24) | |
| | Comparative Example 3 | 88 | 12 | | |
| | Comparative Example 4 | 84 | 16 | | |
| | Comparative Example 5 | 80 | 20 | | |
| Example 5 | | 88 | 12 | | |
| Example 6 | | 84 | 16 | | |
| Example 7 | | 80 | 20 | | |
| Example 8 | | 88 | 12 | | |
| Example 9 | | 84 | 16 | | |
| Example 10 | | 80 | 20 | | |
| Example 11 | | 88 | 12 | | |
| Example 12 | | 84 | 16 | | |
| Example 13 | | 80 | 20 | | |
| Example 14 | | 88 | 12 | | |
| Example 15 | | 88 | 12 | | |
| Example 16 | | 88 | 12 | | |
| Example 17 | | 78 | 12 | | 10 |
| Example 18 | | 88 | 12 | | |
| | Comparative Example 6 | 88 | 12 | | |

(2)

| | | (SZr) dispersion 1 (10 passes) (part) | (SA1) dispersion (10 passes) (part) | (SFe) dispersion (10 passes) (part) | (SZn) dispersion (10 passes) (part) |
|---|---|---|---|---|---|
| | Comparative Example 1 | 20 | | | |
| Example 1 | | 20 | | | |
| Example 2 | | 20 | | | |
| Example 3 | | 20 | | | |
| | Comparative Example 2 | 20 | | | |
| Example 4 | | 20 | | | |
| | Comparative Example 3 | 0 | | | |
| | Comparative Example 4 | 0 | | | |
| | Comparative Example 5 | 0 | | | |
| Example 5 | | | 20 | | |
| Example 6 | | | 20 | | |
| Example 7 | | | 20 | | |
| Example 8 | | | | 20 | |
| Example 9 | | | | 20 | |
| Example 10 | | | | 20 | |
| Example 11 | | | | | 20 |
| Example 12 | | | | | 20 |
| Example 13 | | | | | 20 |
| Example 14 | | | | | |
| Example 15 | | | | | |
| Example 16 | | | | | |
| Example 17 | | | | | |
| Example 18 | | | | | |
| | Comparative Example 6 | 2 | | | |

TABLE 2-continued

| | (3) | | |
|---|---|---|---|
| | (SZr) dispersion Synthesized in oil phase (part) | (SZr) dispersion 2 (3 passes) (part) | Heating process |
| Comparative Example 1 | | | None |
| Example 1 | | | None |
| Example 2 | | | None |
| Example 3 | | | None |
| Comparative Example 2 | | | None |
| Example 4 | | | None |
| Comparative Example 3 | | | None |
| Comparative Example 4 | | | None |
| Comparative Example 5 | | | None |
| Example 5 | | | None |
| Example 6 | | | None |
| Example 7 | | | None |
| Example 8 | | | None |
| Example 9 | | | None |
| Example 10 | | | None |
| Example 11 | | | None |
| Example 12 | | | None |
| Example 13 | | | None |
| Example 14 | 10 | | None |
| Example 15 | 20 | | None |
| Example 16 | 3 | | None |
| Example 17 | 2 | | None |
| Example 18 | | 2 | None |
| Comparative Example 6 | | | Yes |

TABLE 3

| | G' ↑ 100 (Pa) | G' ↑ 100 (Pa) |
|---|---|---|
| Comparative Example 1 | $2.1 \times 10^6$ | $3.5 \times 10^6$ |
| Example 1 | $8.2 \times 10^5$ | $9.3 \times 10^5$ |
| Example 2 | $9.1 \times 10^4$ | $2.3 \times 10^5$ |
| Example 3 | $3.8 \times 10^3$ | $1.8 \times 10^4$ |
| Comparative Example 2 | $7.6 \times 10^2$ | $2.3 \times 10^3$ |
| Example 4 | $3.2 \times 10^5$ | $4.3 \times 10^5$ |
| Comparative Example 3 | $8.0 \times 10^5$ | $7.8 \times 10^5$ |
| Comparative Example 4 | $7.8 \times 10^4$ | $6.5 \times 10^4$ |
| Comparative Example 5 | $3.2 \times 10^3$ | $2.5 \times 10^3$ |
| Example 5 | $8.0 \times 10^5$ | $8.9 \times 10^5$ |
| Example 6 | $8.8 \times 10^4$ | $1.5 \times 10^5$ |
| Example 7 | $4.4 \times 10^3$ | $1.1 \times 10^4$ |
| Example 8 | $8.5 \times 10^5$ | $8.8 \times 10^5$ |
| Example 9 | $6.8 \times 10^4$ | $1.1 \times 10^5$ |
| Example 10 | $3.0 \times 10^3$ | $9.5 \times 10^3$ |
| Example 11 | $6.8 \times 10^5$ | $7.5 \times 10^5$ |
| Example 12 | $9.0 \times 10^4$ | $9.9 \times 10^4$ |
| Example 13 | $4.0 \times 10^3$ | $5.1 \times 10^3$ |
| Example 14 | $8.7 \times 10^4$ | $2.5 \times 10^5$ |
| Example 15 | $8.9 \times 10^4$ | $4.0 \times 10^5$ |
| Example 16 | $9.0 \times 10^4$ | $9.5 \times 10^5$ |
| Example 17 | $6.3 \times 10^4$ | $1.2 \times 10^5$ |
| Example 18 | $8.8 \times 10^4$ | $1.5 \times 10^5$ |
| Comparative Example 6 | $2.4 \times 10^5$ | $2.2 \times 10^5$ |

The toners of Examples and Comparative Examples were set in an image forming apparatus to evaluate.

A digital full-color multifunctional printer MP C6003 from Ricoh Company Ltd. was used as the apparatus.

<Evaluation of Fixability>

A solid image having a size of 3 cm×15 cm was produced on PPC paper 6000<70W>A4 "Tateme" (Longitudinal machine direction) from Ricoh Company, Ltd. so as to have a toner adhering to the image in an amount of 0.85 mg/cm$^2$. The fixing temperature was decreased 1° C. by 1° C. from 160° C. and an image was produced every degree of temperature to visually observe adherence of the toner to paper to determine the temperature at which cold offset started occurring.

<Evaluation of Blocking Resistance>

A solid image having a size of 3 cm×15 cm were continuously produced on each one side of PPC paper 6000<70W>A4 "Tateme" (Longitudinal machine direction) from Ricoh Company, Ltd with a run length of 200 sheets so as to have a toner adhering to each of the images in an amount of 0.85 mg/cm$^2$. The fixing temperature was controlled to be cold offset temperature+20° C. on average. The 200 produced images were left for 1 hr while stacked and sticking between images was evaluated.

(Criteria of Blocking Property Evaluation)

Excellent: No sticking

Good: Slight sticking, but the paper was easily separated from each other causing no problem to the image Average: Slight sticking and slight noises were made when the paper was separated from each other causing no problem to the image Fair: Slight sticking and the image gloss slightly changed when the paper was separated from each other Poor: The paper stuck to each other and the image and the paper were damaged when the paper were separated.

<Evaluation of Image Storage Property>

A solid image having a size of 3 cm×15 cm was produced on one side of a PPC paper 6000<70W>A4 "Tateme" (Longitudinal machine direction) from Ricoh Company, Ltd. so as to have a toner adhering to the image in an amount of 0.85 mg/cm$^2$. The fixing temperature was controlled to be cold offset temperature+20° C. on average. The resultant images were brought into contact with each other, a weight equivalent to 8 kPa was placed thereon, and left for 1 week under an environment of 60° C. and 50% RH. Thereafter, they were peeled off from each other to observe the peeled-off state.

(Criteria of Image Storage Property Evaluation)

Excellent: The paper did not stick to each other at all or there were no missing in images or no image transfer Good: The paper slightly stuck to each other (slight noise) when peeled off from each other. However, they were easily separated from each other without any missing in image and image transfer.

Fair: The paper stuck to each other and there were missing in images and image transfer Poor: The paper stuck to each other and there were serious missing in images and the papers broke The evaluation results of each of the toner are shown in Table 4 with the rate of change $R_M$ of weight-average molecular weight and the rate of change $R_{AV}$ of acid value of each of the toner.

TABLE 4

| | | Fixability | Fixing Temperature (° C.) | Blocking Resistance | $R_M$ (%) | $R_{AV}$ (%) | Image Preservability |
|---|---|---|---|---|---|---|---|
| | Comparative Example 1 | Poor | 160 | Good | 5 | 60 | Fair |
| Example 1 | | Fair | 135 | Good | 12 | 55 | Excellent |
| Example 2 | | Good | 125 | Excellent | 30 | 48 | Excellent |
| Example 3 | | Good | 120 | Good | 55 | 35 | Good |
| | Comparative Example 2 | Excellent | 110 | Poor | 90 | 25 | Fair |
| Example 4 | | Good | 125 | Excellent | 0 | 0 | Excellent |
| | Comparative Example 3 | Fair | 135 | Poor | 0 | 0 | Poor |
| | Comparative Example 4 | Good | 120 | Poor | 0 | 0 | Poor |
| | Comparative Example 5 | Good | 125 | Poor | 0 | 0 | Poor |
| Example 5 | | Fair | 130 | Average | 7 | 42 | Good |
| Example 6 | | Good | 125 | Good | 20 | 30 | Good |
| Example 7 | | Good | 115 | Good | 30 | 21 | Fair |
| Example 8 | | Fair | 125 | Average | 5 | 45 | Excellent |
| Example 9 | | Good | 120 | Good | 12 | 33 | Good |
| Example 10 | | Good | 115 | Good | 23 | 26 | Good |
| Example 11 | | Fair | 125 | Average | 8 | 38 | Excellent |
| Example 12 | | Good | 120 | Fair | 15 | 22 | Good |
| Example 13 | | Good | 115 | Fair | 21 | 15 | Fair |
| Example 14 | | Good | 115 | Good | 30 | 74 | Excellent |
| Example 15 | | Good | 120 | Excellent | 60 | 59 | Excellent |
| Example 16 | | Good | 120 | Excellent | 150 | 85 | Excellent |
| Example 17 | | Excellent | 110 | Excellent | 12 | 63 | Good |
| Example 18 | | Good | 120 | Fair | 5 | 8 | Fair |
| | Comparative Example 6 | Fair | 160 | Fair | 5 | 7 | Good |

As seen in Table 4, toner having low $R_{AV}$ are not easily reacting during fixing and has poor blocking property.

The image forming apparatus of the present invention is capable of fixing at low temperatures, saving power consumption, and producing images having good blocking property and image storage property.

What is claimed is:

1. A toner fixable on an image bearer with heat, comprising a binder resin and a salicylic acid metal salt derivative, wherein the toner has a first storage modulus of from $1\times10^3$ to $1\times10^6$ Pa, measured at 100° C. when being heated, and a second storage modulus of from $1\times10^3$ to $1\times10^6$ Pa, measured at 100° C. when being cooled, the first storage modulus and second storage modulus being measured by a rheometer, and wherein the second storage modulus at 100° C. when being cooled is higher than the first storage modulus at 100° C. when being heated.

2. The toner of claim 1, wherein the first storage modulus is from $1\times10^4$ to $1\times10^5$ Pa, measured at 100° C. when being heated, and the second storage modulus is from $1\times10^4$ to $1\times10^5$ Pa, measured at 100° C. when being cooled.

3. The toner of claim 1, wherein a rate of change $R_M$ (%) determined from the following formula (1) is from 10% to 140%:

$$R_M=(Mw2-Mw1)/Mw1\times100 \quad (1)$$

wherein Mw1 represents a weight-average molecular weight of the toner before heated; and Mw2 represents a weight-average molecular weight of the toner after heated.

4. The toner of claim 3, wherein the rate of change $R_M$ (%) is from 30% to 80%.

5. The toner of claim 1, comprising a crystalline polyester resin.

6. The toner of claim 1, comprising a binder resin, wherein the binder resin includes:

a polyester resin having an acid value; and a member selected from the group consisting of a metal complex or salt of a salicylic acid having the following formula (2) and a metal complex or salt of a hydroxyl naphthoic acid derivative:

(2)

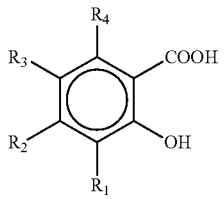

wherein $R^1$, $R^2$, $R^3$ and $R^4$ independently represent a member selected from the group consisting of a hydrogen atom, an alkyl group having 1 to 12 carbon atoms, an alkenyl group having 1 to 12 carbon atoms, —OH, —$NH_2$, —NH($CH_3$), —N($CH_3$)$_2$, —$OCH_3$, —O($C_2H_5$), —COOH and —$CONH_2$; and the metal salt is a member selected from the group consisting of $Zn^{2+}$, $Al^{3+}$, $Cr^{3+}$, $Fe^{3+}$ or $Zr^{4+}$.

7. The toner of claim 1, wherein a rate of change $R_{AV}$ (%) determined from the following formula (3) is from 20% to 80%:

$$R_{AV}=(Av2-Av1)/Av1\times 100 \quad (3)$$

wherein Av1 represents an acid value of the toner before heated; and Av2 represents an acid value of thereof after heated.

8. A method of producing the toner according to claim 1, comprising:

dissolving or dispersing at least a binder resin in an organic solvent to prepare a solution or a first dispersion;

dispersing or emulsifying the solution or the dispersion in an aqueous medium to prepare an emulsion or a second dispersion; and removing the organic solvent from the emulsion or the dispersion.

9. A toner housing unit housing the toner according to claim 1.

10. An image forming apparatus, comprising:

a photoconductor;

a charger to charge the photoconductor;

an irradiator to irradiate the photoconductor to form an electrostatic latent image on the photoconductor;

an image developer to develop the electrostatic latent image with the toner according to claim 1 to form a toner image on the photoconductor;

a transferer to transfer the toner image onto a recording medium; and a fixer to fix the toner image on the recording medium.

11. An image forming method, comprising:

forming an electrostatic latent image on a photoconductor;

developing the electrostatic latent image with the toner according to claim 1 to form a toner image on the photoconductor;

transferring the toner image onto a recording medium; and fixing the toner image on the recording medium.

12. The toner of claim 1, further comprising a crystalline polyester resin and wherein the binder resin includes:

a polyester resin having an acid value; and a member selected from the group consisting of a metal complex or salt of a salicylic acid having the following formula (2) and a metal complex or salt of a hydroxyl naphthoic acid derivative:

(2)

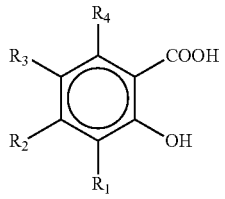

wherein $R^1$, $R^2$, $R^3$ and $R^4$ independently represent a member selected from the group consisting of a hydrogen atom, an alkyl group having 1 to 12 carbon atoms, an alkenyl group having 1 to 12 carbon atoms, —OH, —$NH_2$, —NH($CH_3$), —N($CH_3$)$_2$, —$OCH_3$, —O($C_2H_5$), —COOH and —$CONH_2$; and the metal salt is a member selected from the group consisting of $Zn^{2+}$, $Al^{3+}$, $Cr^{3+}$, $Fe^{3+}$ or $Zr^{4+}$.

* * * * *